US007184686B2

(12) United States Patent
Kanno et al.

(10) Patent No.: US 7,184,686 B2
(45) Date of Patent: Feb. 27, 2007

(54) PROCESS CARTRIDGE HAVING DEVELOPING ROLLER AND PHOTOSENSITIVE DRUM THAT CAN CONTACT AND BECOME SPACED APART FROM EACH OTHER AND ELECTROPHOTOGRAPHIC IMAGE FORMING APPARATUS MOUNTING SUCH CARTRIDGE

(75) Inventors: Kazuhiko Kanno, Odawara (JP); Koji Hashimoto, Shizuoka-ken (JP); Kinya Harada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/950,574

(22) Filed: Sep. 28, 2004

(65) Prior Publication Data

US 2006/0045566 A1 Mar. 2, 2006

(30) Foreign Application Priority Data

Aug. 31, 2004 (JP) ..... 2004-253012

(51) Int. Cl.
*G03G 21/16* (2006.01)

(52) U.S. Cl. ..... 399/111

(58) Field of Classification Search ..... 399/25, 399/110, 111, 113

See application file for complete search history.

(56) References Cited

U.S. PATENT DOCUMENTS

| | | | | |
|---|---|---|---|---|
| 6,795,673 | B2 * | 9/2004 | Yoshizawa | 399/111 X |
| 2002/0110386 | A1 | 8/2002 | Kanno et al. | 399/111 |
| 2003/0156856 | A1 * | 8/2003 | Arimitsu et al. | 399/114 |
| 2005/0025521 | A1 * | 2/2005 | Mori et al. | 399/111 |
| 2005/0069342 | A1 * | 3/2005 | Kanno et al. | 399/111 |

* cited by examiner

*Primary Examiner*—Sandra L. Brase
(74) *Attorney, Agent, or Firm*—Fitzpatrick, Cella, Harper & Scinto

(57) ABSTRACT

A process cartridge detachably mountable to a main assembly of an electrophotographic image forming apparatus including a cam movable between first and second positions. The cartridge includes a photosensitive drum, a developing roller contactable to the drum to develop a latent image on the drum, a first frame supporting the drum, a second frame supporting the roller and connected with the first frame for rotation about a rotational axis so that roller and the drum are contacted to or spaced from each other, a cam engaging portion for receiving from the cam which is located at the first position a force to space the roller and the drum from each other in a state in which upward movement of the first frame is limited when the cartridge is mounted to the main assembly.

9 Claims, 24 Drawing Sheets

PROCESS CARTRIDGE HAVING DEVELOPING ROLLER AND PHOTOSENSITIVE DRUM THAT CAN CONTACT AND BECOME SPACED APART FROM EACH OTHER AND ELECTROPHOTOGRAPHIC IMAGE FORMING APPARATUS MOUNTING SUCH CARTRIDGE

FIELD OF THE INVENTION AND RELATED ART

The present invention relates to a process cartridge and an electrophotographic image forming apparatus.

Here, an electrophotographic image forming apparatus is an apparatus for forming an image on recording medium (paper, an OHP sheet, fabric, etc.) with the use of one of the electrophotographic image forming methods. As for the examples of an electrophotographic image forming apparatus, there are an electrophotographic copying machine, an electrophotographic printer (for example, laser beam printer, LED printer. etc.), a facsimile machine, a word processor, etc.

A process cartridge is a cartridge in which a minimum of a developing means (development roller) as a processing means, and an electrophotographic photosensitive drum, are integrally placed, and which is removably mountable in the main assembly of an electrophotographic image forming apparatus.

A process cartridge system in which an electrophotographic photosensitive drum (which hereinafter will be referred to as a "photosensitive drum"), and a single or plurality of processing means, which act on the photosensitive drum, are integrally placed in a cartridge removably mountable in the main assembly of an image forming apparatus, has been employed in the field of an electrophotographic image forming apparatus. A process cartridge system enables an operator to maintain an electrophotographic image forming apparatus on his own, without relying on professional personnel. Therefore, it is widely used in the field of an electrophotographic image forming apparatus.

As an example of the above-described process cartridge, a process cartridge of a contact development type has been known, in which a photosensitive drum, and a development roller, which is develops a latent image on the photosensitive drum by being placed in contact therewith, are integrally placed.

A cartridge of this type is structured so that during image formation, the development roller is kept pressed against the photosensitive drum to keep a predetermined amount of contact pressure between the development roller and the photosensitive drum. Therefore, the developer on the peripheral surface of the development roller adheres to the peripheral surface of the photosensitive drum while the development roller is not in operation (while an image is being not formed), making it possible that the developer having adhered to the peripheral surface of the photosensitive drum will adhere to a recording medium.

Thus, a process cartridge is structured so that the entirety of the development unit of the cartridge is rotatably suspended from the photosensitive member unit of the cartridge. More specifically, each end of the development unit is provided with a shaft hole, through which a connective shaft is put, rotatably suspending the development unit from the photosensitive drum unit. Further, the development unit is kept pressured by a pair of springs or the like so that the developing member is kept in contact with the photosensitive drum by the force generated by the pair of springs or the like in the direction to rotate the development unit about the connective shafts.

On the other hand, the main assembly side is provided with a means for keeping the development roller away from the photosensitive drum. The developer roller separating means keeps the development unit pressured upward, by applying a predetermined amount of predetermined force to the pressure catching points of the development unit, keeping the development roller away from the photosensitive drum. When mounting the cartridge into the apparatus main assembly, the pressure catching portions of the development unit is moved onto the separating means which is on standby at the separation point. Therefore, as the cartridge is mounted into the main assembly of an image forming apparatus, the development roller is moved away from the photosensitive drum by a predetermined distance, and remains separated from the photosensitive drum until an image forming operation is started. Such a cartridge design as the one described above has been known (US AA2002110386).

SUMMARY OF THE INVENTION

The above described prior art was completely satisfactory to meet the level of performance expected in the past. In recent years, however, the level of performance expected of an electrophotographic image forming apparatus has become much higher.

Thus, the present invention is a further development of the above described art, and its primary object is to provide a combination of a process cartridge and an electrophotographic image forming apparatus capable of more reliably separating, and keeping separated, the development roller from the photosensitive drum than that in accordance with the prior art.

Another object of the present invention is to provide a combination of a process cartridge and an electrophotographic image forming apparatus capable of separating the development roller from the photosensitive drum at a higher level of accuracy than that in accordance with the prior art.

Another object of the present invention is to provide a combination of a process cartridge and an electrophotographic image forming apparatus, which reduces the amount of the shock which occurs as the cam follower portions of the cartridge come into contact with the functional surfaces of the cams of the apparatus main assembly of the image forming apparatus while the process cartridge is mounted into the main assembly of the image forming apparatus.

Another object of the present invention is to provide a combination of a process cartridge and an electrophotographic image forming apparatus, which reduces the shock which occurs when mounting the process cartridge into the main assembly of the image forming apparatus, and is superior to an image forming apparatus in accordance with the prior art, in the efficiency with which the process cartridge is mountable.

According to an aspect of the present invention, there is provided a process cartridge detachably mountable to a main assembly of an electrophotographic image forming apparatus, the process cartridge including a cam member movable between a first position and a second position which is retracted from the first position, the process cartridge comprising an electrophotographic photosensitive drum; a developing roller contactable to the electrophotographic photosensitive drum at a development position to develop an electrostatic latent image formed on the electrophotographic photosensitive drum; a first frame supporting the electrophotographic photosensitive drum; second frame supporting the developing roller, the second frame being connected with the first frame for rotation about a rotational axis so that the developing roller and the electrophotographic photosensitive drum are contacted to or spaced from each other; a cam engaging portion for receiving from the cam member which is located at the first position a force effective to space the developing roller and the electrophotographic photosensitive drum from each other in a state in which upward movement of the first frame is limited when the process cartridge is mounted to the main assembly, the cam engaging portion being provided on the second frame at a position downstream of the development position with respect to a process cartridge mounting direction at a side of the cartridge across the rotational axis from the development position with respect to the process-cartridge mounting direction; a portion to be guided for being engaged and guided by a guide surface provided in the main assembly when the process cartridge is mounted to the main assembly, wherein the portion to be guided is guided by the guide surface such that the cam engaging portion moves above a tangent line, parallel to the mounting direction, of a cam surface of the cam member to permit the cam engaging portion to be brought into contact with the cam surface from an above the cam surface.

According to another aspect of the present invention, there is provided an electrophotographic image forming apparatus usable with such a process cartridge.

These and other objects, features, and advantages of the present invention will become more apparent upon consideration of the following description of the preferred embodiments of the present invention, taken in conjunction with the accompanying drawings.

BRIEF DESCRIPTION OF DRAWINGS

FIG. 9(*b*) is a schematic drawing for illustrating the sequence for mounting the process cartridge into the apparatus main assembly, on the driven side.

FIG. 9(*c*) is a schematic drawing for illustrating the sequence for mounting the process cartridge into the apparatus main assembly, on the driven side.

FIG. 9(*d*) is a schematic drawing for illustrating the sequence for mounting the process cartridge into the apparatus main assembly, on the driven side.

FIG. 9(*e*) is a schematic drawing for illustrating the sequence for mounting the process cartridge into the apparatus main assembly, on the driven side.

FIG. 9(*f*) is a schematic drawing for showing the process cartridge ready for image formation, on the driven side.

FIG. 10(*b*) is a schematic drawing for illustrating the sequence for mounting the process cartridge into the apparatus main assembly, on the non-driven side.

FIG. 10(*c*) is a schematic drawing for illustrating the sequence for mounting the process cartridge into the apparatus main assembly, on the non-driven side.

FIG. 10(*d*) is a schematic drawing for illustrating the sequence for mounting the process cartridge into the apparatus main assembly, on the non-driven side.

FIG. 10(*e*) is a schematic drawing for illustrating the sequence for mounting the process cartridge into the apparatus main assembly, on the non-driven side.

FIG. 10(*f*) is a schematic drawing for showing the process cartridge ready for image formation, on the non-driven side.

DETAILED DESCRIPTION OF THE PREFERRED EMBODIMENTS

Hereinafter, the preferred embodiments of the present invention will be described in detail with reference to the appended drawings. It should be noted here that the measurement, materials, and shapes of the structural components in the following embodiment of the present invention, and their positional relationship, are not intended to limit the scope of the present invention, unless specifically noted. Further, once a given structural component is described regarding its material, shape, etc., it will be the same in material, shape, etc., throughout this document, unless specifically noted.

Also in the following description of the embodiments of the present invention, the lengthwise direction of a process cartridge means the direction intersecting (perpendicular) the direction in which the process cartridge is mounted into, or removed from, the main assembly of the image forming apparatus. It coincides with the lengthwise direction of the development roller, and the lengthwise direction of the electrophotographic photosensitive drum. Further, the top side (surface) of the process cartridge means the side (surface) of the process cartridge which will be on the top side when the process cartridge is in the apparatus main assembly, and the bottom side (surface) of the process cartridge means the side (surface) of the process cartridge which will be on the bottom side when the process cartridge is in the main assembly.

Further, the left and right sides of the electrophotographic image forming apparatus means the left and right sides of the apparatus, as seen by an operator who is facing the entrance of the process cartridge compartment portion of the apparatus main assembly. In the case of the electrophotographic image forming apparatus in this embodiment, the right side is the side from which the apparatus is driven (which hereinafter will be referred to as the driven side), and the left side is the side from which the apparatus is not driven (which hereinafter will be referred to as the non-driven side). The numerical symbols designating the components, member, etc., located on the right-hand and left-hand sides are given subordinate symbols R and L, respectively, to differentiate the sides to which they belong.

Embodiment 1

(General Structure of Electrophotographic Image Forming Apparatus)

Figure 1:
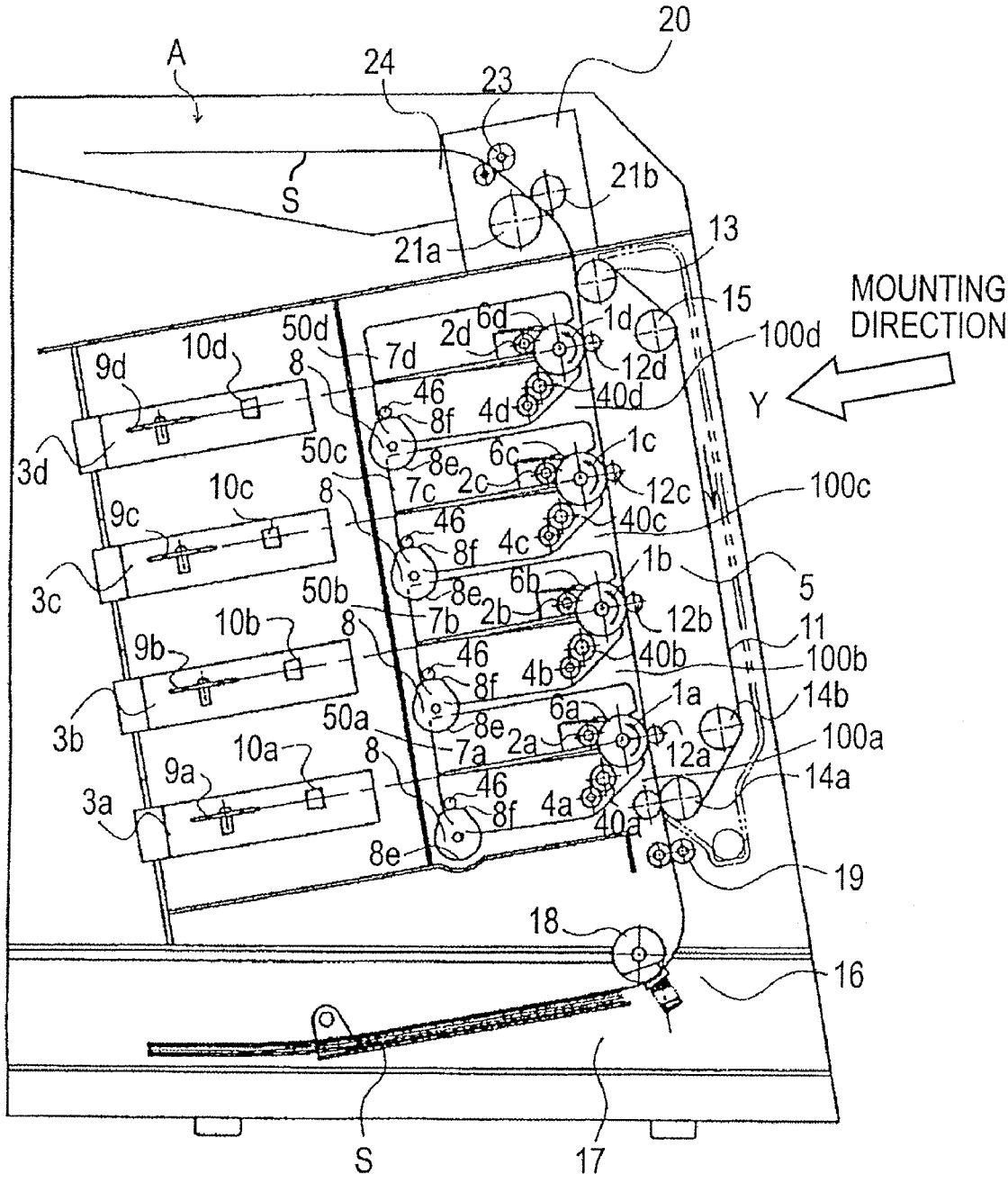
FIG. 1 is a schematic sectional view of the entirety of the electrophotographic color image forming apparatus in the preferred embodiment of the present invention.

First, referring to FIG. 1, the general structure of the electrophotographic image forming apparatus in this embodiment will be described. FIG. 1 is a schematic sectional view of the electrophotographic image forming apparatus in this embodiment.

The electrophotographic image forming apparatus A (which hereinafter may be referred to as the "main assembly of image forming apparatus" or simply as the "apparatus main assembly") has four process cartridge compartments (100*a*–100*d*), which are virtually vertically stacked in parallel, and in which four process cartridges (which hereinafter may be referred to as "cartridges 7 (7*a*–7*d*)") having an electrophotographic photosensitive drum (which hereinafter may be referred to as a "photosensitive drum") 1 (1*a*–1*d*) are mountable one for one.

The photosensitive drum 1 is rotationally driven in the counterclockwise direction (FIG. 1) by the driving force from a motor (unshown). In the adjacencies of the peripheral surface of the photosensitive drum 1, the following components are placed. Listing in the order of placement in terms of the rotational direction of the photosensitive drum 1, there are: a charging means 2 (2*a*–2*d*) for uniformly charging the peripheral surface of the photosensitive drum 1; a scanner unit 3 (3*a*–3*d*) for forming an electrostatic latent image on the peripheral surface of the photosensitive drum 1, by projecting a beam of laser light onto the peripheral surface of the photosensitive drum 1 while modulating the beam of laser light with image formation data; a development roller 40 (40*a*–40*d*) for developing the electrostatic latent image with the use of developer; an electrostatic transferring means 5 for transferring the image formed of developer on the peripheral surface of the photosensitive drum 1 onto a recording medium S; and a cleaning means 6 (6*a*–6*d*) for removing the developer remaining on the peripheral surface of the photosensitive drum 1 after the image transfer. The photosensitive drum 1, the charging means 2, the development unit 4 (4*a*–4*d*) as the unit in the second frame, the cleaning means 6, and the development roller 40 are integrally placed in a cartridge, making up the process cartridge 7, which will be described later The photosensitive drum 1 comprises an aluminum cylinder, and a layer of organic photoconductive substance (OPC member) coated across the entirety of the peripheral surface of the aluminum cylinder. It is rotatably supported by a pair of supporting members, by its lengthwise ends. To one end of the photosensitive drum 1, the force for driving the photosensitive drum 1 is transmitted from a motor (unshown). With the transmission of the driving force, the photosensitive drum 1 is rotationally driven in the counterclockwise direction.

The charging means 2 is in the form of an electrically conductive roller (2*a*–2*d*), and is placed in contact with the peripheral surface of the photosensitive drum 1. To this roller (2*a*–2*d*), charge bias is applied from the apparatus main assembly A, to uniformly charge the peripheral surface of the photosensitive drum 1.

The scanner unit 3 is positioned roughly at the same level as the photosensitive drum 1. The beam of light emitted, while being modulated with the video signals, from a laser diode (unshown) is projected upon a polygon mirror (9*a*–9*d*), which is being rotated by a scanner motor (unshown). The beam of image formation light reflected (deflected) by the mirror is focused on the peripheral surface of the photosensitive drum 1 by a focal lens (10*a*–10*d*). As a result, the numerous points of the uniformly charged peripheral surface of the photosensitive drum 1 are selectively exposed. Consequently, an electrostatic latent image reflecting the video signals is formed on the peripheral surface of the photosensitive drum 1.

Figure 2:
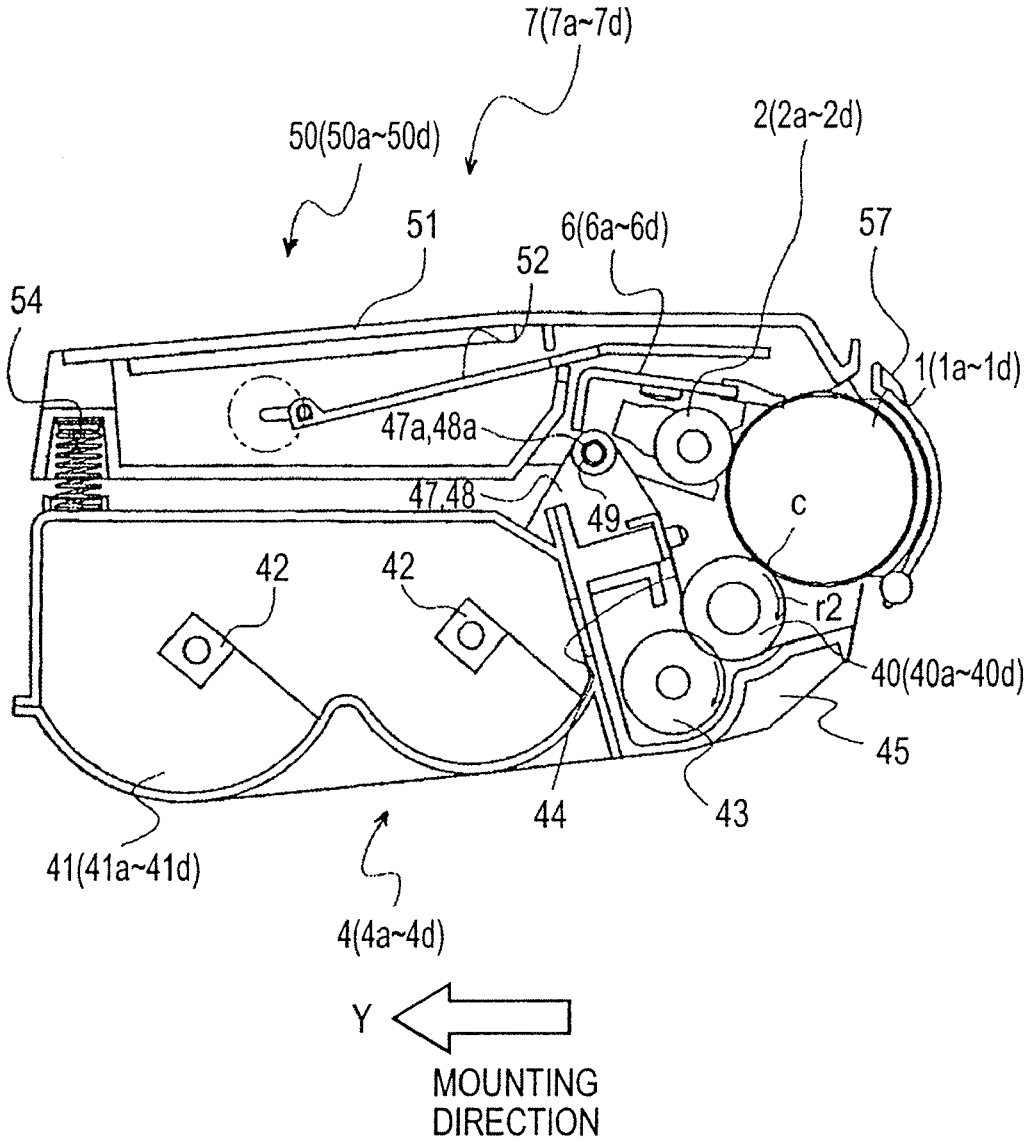
FIG. 2 is a schematic sectional view of the process cartridge in the first embodiment of the present invention.

Referring to FIG. 2, the development units 4 (4*a*–4*d*) have developer containers 41 (41*a*–41*d*) in which four color toners (yellow, magenta, cyan, and black toners) are stored one for one, and a developing means holding frame 45.

The developer is sent to the developer supply roller 43 by the developer conveyance mechanism 42 in the developer container 41. Then, the developer is uniformly coated on the peripheral surface of the development roller 40, while being triboelectrically charged, by the development supply roller 43, and while the development blade 44 is kept pressed on the peripheral surface of the development roller 40 (40*a*–40*d*) with the application of a predetermined amount of pressure. The development roller 40 is positioned so that its peripheral surface directly opposes the peripheral surface of the photosensitive drum 1. Designated by a reference symbol C is the development station, in which the development roller 40 is kept pressed upon the photosensitive drum 1 with the application of a predetermined amount of pressure.

To the development roller 40, development bias is applied from the apparatus main assembly A. As a result, the electrostatic latent image formed on the peripheral surface of the photosensitive drum 1 is developed by the developer.

On the other hand, the main assembly A of the image forming apparatus is provided with a transfer belt 11, which is positioned so that it opposes all the photosensitive drums 1 (1*a*–1*d*), and is circularly driven in contact with all of the photosensitive drums 1 (1*a*–1*d*). The recording medium S is conveyed by the transfer belt 11 to the transfer station, in which the developer image on the peripheral surface of each of the photosensitive drums 1 (1*a*–1*d*) is transferred onto the recording medium S.

The transfer rollers (12*a*–12*d*) are in contact with the inward surface of the transfer belt 11, in terms of the loop the transfer belt 11 forms. They are positioned so that they oppose the four photosensitive drums 1, one for one. Through these transfer rollers (12*a*–12*d*), positive electric charge is applied to the recording medium S, causing the developer image on the photosensitive drum 1 to transfer onto the recording medium S. The transfer belt 11 is wrapped around four rollers, which are the driver roller 13, follower rollers 14*a* and 14*b*, and tension roller 15, being suspended thereby, and is circularly driven. While the recording medium S is conveyed from the position of the follower roller 14*a* to the position of the driver roller 13 by the belt 11, the developer images are transferred onto the recording medium S.

The feeding station 16 is the station which feeds the recording medium S into the image formation station. It has a feeder cassette 17 in which a plurality of recording media S are stored. During image formation, a feed roller 18, and a pair of registration rollers 19, are rotated in synchronism with the progression of the image forming operation, taking the recording mediums S from the cassette 17, one by one, and feeding them into the apparatus main assembly A. As the leading end of the recording medium S reaches the pair of registration rollers 19, it is temporarily stopped by the registration rollers 19. Then, it is released in synchronism with the rotation of the transfer belt 11, and the progression of the formation of the developer images, and is conveyed to the transfer belt, by the rollers 19.

A fixation station 20 is the station in which the plurality of developer images different in color, which have just been transferred onto the recording medium S, are fixed to the recording medium S.

The image forming operation of the image forming apparatus in this embodiment is as follows. First, the cartridges 7 (7*a*–7*d*) are sequentially driven with the predetermined image formation timing. As the cartridges 7 (7*a*–7*d*) are sequentially driven, the photosensitive drums 1 (1*a*–1*d*) are rotationally driven, along with the scanner units 3 positioned so that they oppose the cartridges 7 (7*a*–7*d*), respectively. As the photosensitive drums 1 (1*a*–1*d*) are rotationally driven, the charging means 2 (2*a*–2*d*) uniformly charge the peripheral surfaces of the photosensitive drums 1 (1*a*–1*d*). The units 3 expose the peripheral surfaces of the photosensitive drums 1 with the beam of light modulated with the video signals. As a result, electrostatic latent images are formed on the peripheral surfaces of the photosensitive drums 1. The development rollers 40 (40*a*–40*d*) develop the electrostatic latent images on the peripheral surfaces of the photosensitive drums 1 (1*a*–1*d*).

As described before, onto the recording medium S, the developer images on the photosensitive drums 1 are sequentially transferred by the electric fields formed between each of the photosensitive drums 1, and the corresponding transfer roller. After the transfer of four developer images different in color onto the transfer medium S, the transfer medium S is separated from the transfer belt 11 by the curvature of the driver roller 13. Thereafter, the recording medium S is conveyed into the fixation station 20, in which the developer images on the recording medium S are thermally fixed the recording medium S while the recording medium S is conveyed through the fixation nip, that is, the contact area between the fixation roller 21*a* and pressure roller 21*b*, remaining pinched between the two rollers 21*a* and 21*b*. Then, the recording medium S is discharged out of the apparatus main assembly A through the recording medium outlet 24 by a pair of discharge rollers 23.

Incidentally, FIG. 1 shows the image forming apparatus in which the development roller 40 in each cartridge 7 remains separated from the photosensitive drum 1.

(Process Cartridge)

Referring to FIG. 2, the cartridge 7 in this embodiment will be described. FIG. 2 is a sectional view of one of the cartridges 7 in this embodiment.

Incidentally, the cartridge 7*a* containing the yellow color developer, the cartridge 7*b* containing the magenta color developer, the cartridge 7*c* containing the cyan color developer, and the cartridge 7*d* containing the black color developer are identical in structure.

The cartridge 7 comprises the photosensitive member unit 50 (50*a*–50*d*) and development unit 4 (4*a*–4*d*) integrally connected to each other. The photosensitive member unit 50 (50*a*–50*d*) is made up of the photosensitive drum 1, the charging means (charge roller 2*a*–2*d*) 2, the cleaning means 6, and the first frame in which the preceding components are held, whereas the development unit 4 (4*a*–4*d*) is made up of the development roller 40 (40*a*–40*d*), and the second frame in which the development roller 40 (40*a*–40*d*) is supported.

Figure 4:
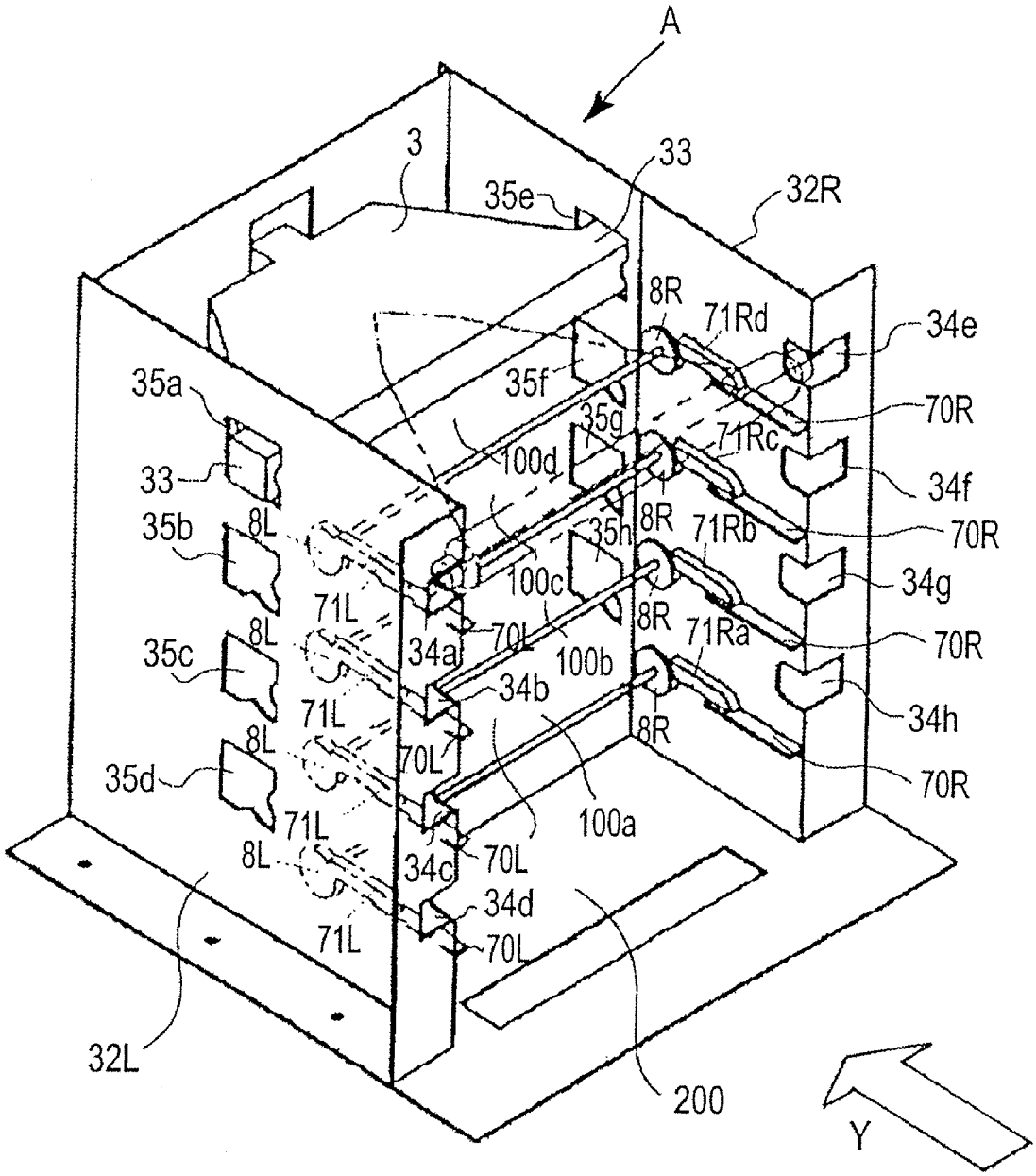
FIG. 4 is a schematic perspective view of the portion (cartridge compartment portion) of the main assembly of the image forming apparatus, into which the cartridges are mounted, showing the structure thereof.
Figure 7:
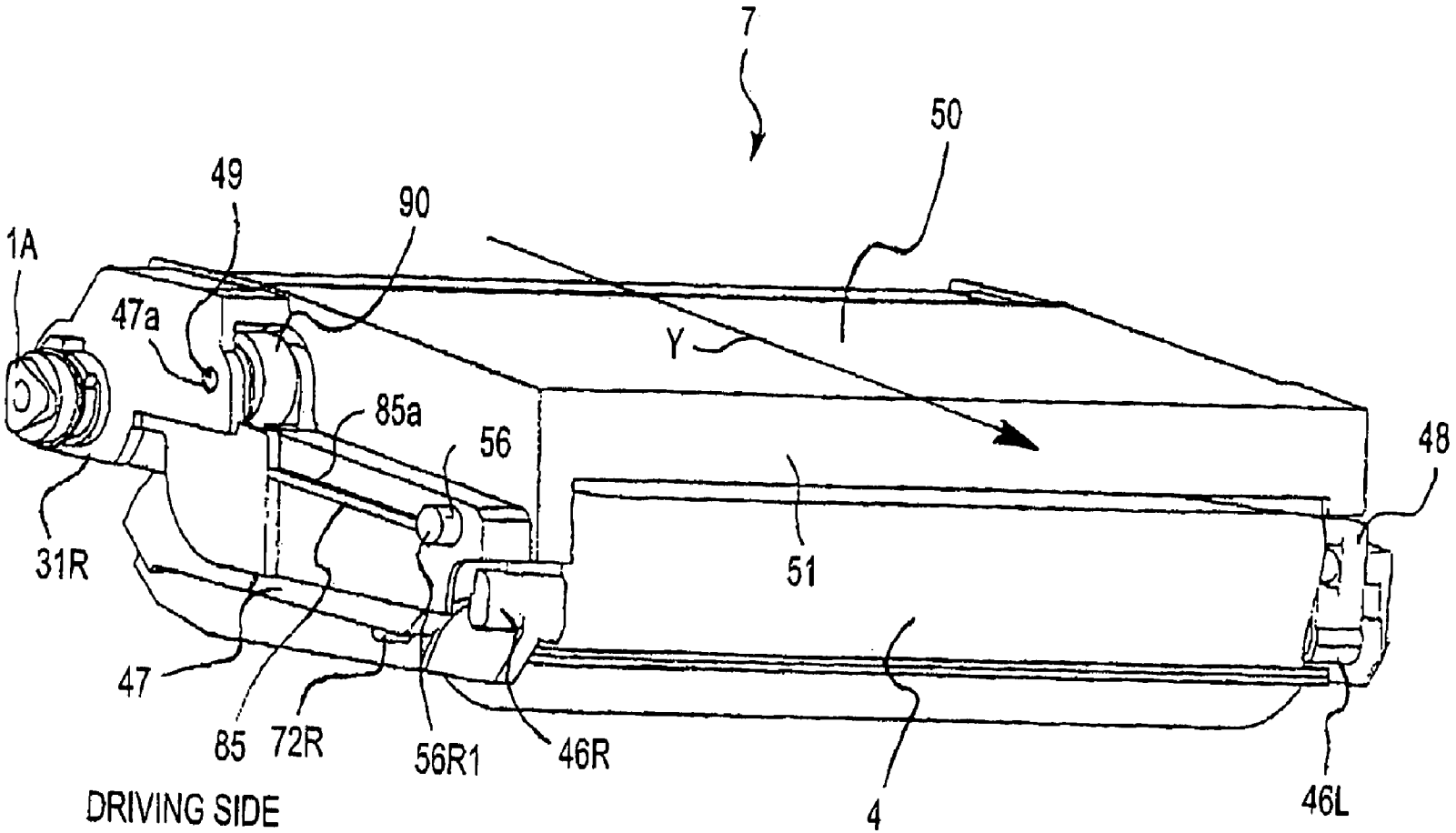
FIG. 7 is a perspective view of the developer roller separating portion (on the driven side) of the process cartridge, showing the structure thereof.
Figure 8:
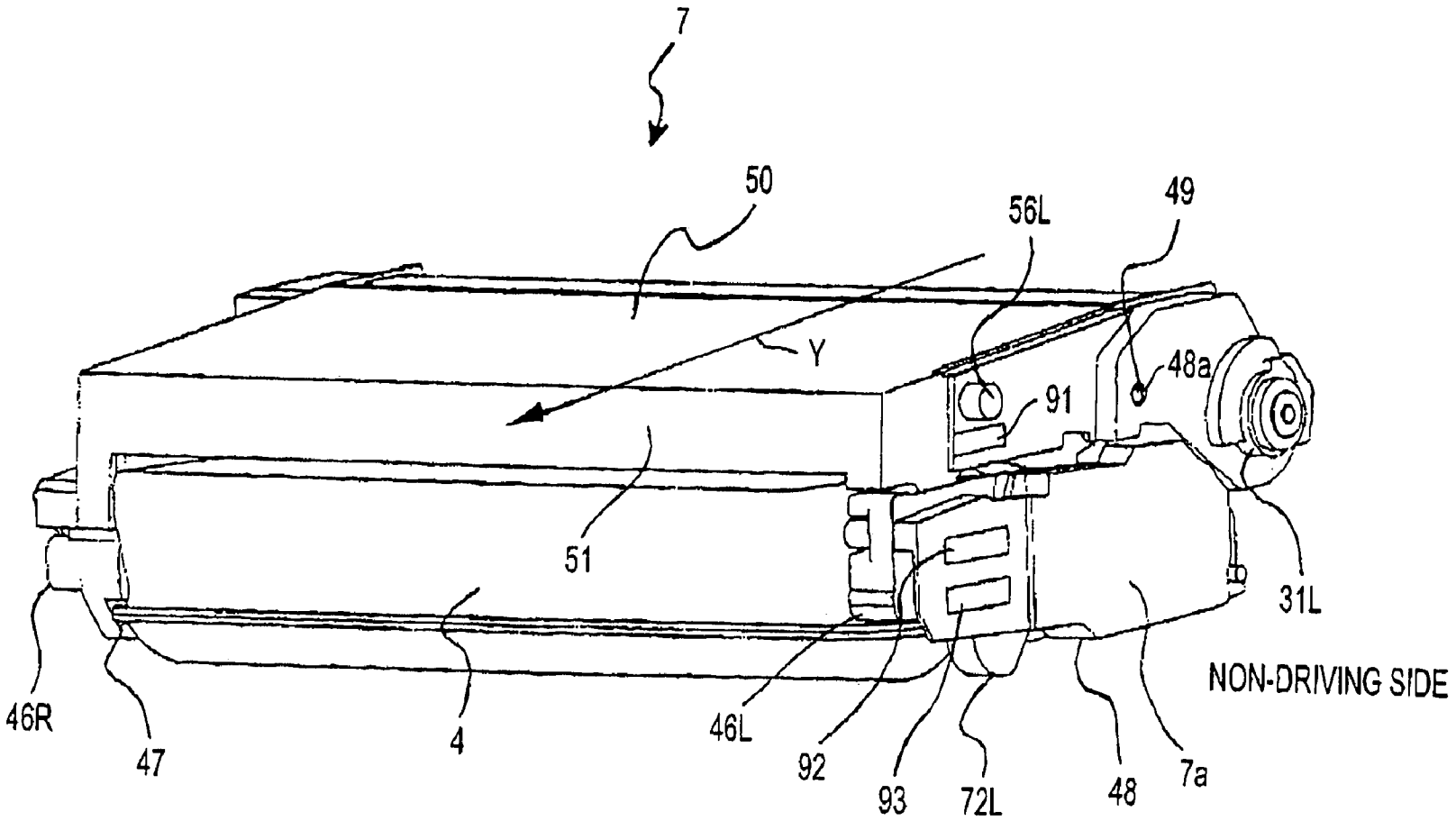
FIG. 8 is a perspective view of the developer roller separating portion (on the non-driven side) of the process cartridge, showing the structure thereof.

The photosensitive unit 50 comprises the cleaning means frame 51, and the photosensitive drum 1 rotatably supported by the cleaning means frame 51 with the placement of the bearings 31 (31R and 31L: FIGS. 4, 7, and 8) between the photosensitive drum 1 and cleaning means frame 51. In the adjacencies of the peripheral surface of the photosensitive drum 1, the aforementioned charging means 2, and the cleaning blade 6 (6*a*–6*d*) as the cleaning means 6, are positioned. The residual developer, or the developer remaining on the peripheral surface of the photosensitive drum 1 is removed by the cleaning blade 6, and the removed residual developer is sent by a developer conveying mechanism 52, to a removed developer chamber 53 located in the rear portion of the cleaning means frame 51. As the driving force is transmitted to the photosensitive member unit 50 (50*a*–50*d*) from the motor (unshown), the photosensitive drum 1 rotates in synchronism with the image formation steps.

The development unit 4 (4*a*–4*d*) comprises: the development roller 40 (40*a*–40*d*) which rotates in the direction indicated by an arrow mark r2 in contact with the photosensitive drum 1; the developer container 41 containing the developer; and the developing means holding frame 45. The development roller 40 is rotatably supported by the developing means holding frame 45 with the placement of a pair of bearings 47 and 48 between the development roller 40 and frame 45. In the adjacencies of the peripheral surface of the development roller 40, the developer supply roller 43 and development blade 44 are positioned. Further, in the developer container 41, a developer conveying mechanism 42 is disposed, which is for conveying the developer in the container to the developer supply roller 43 while stirring the developer.

The development unit 4 (4*a*–4*d*) is connected to the photosensitive member unit 50, being enabled to rotationally move relative to the photosensitive member unit 50. More specifically, the development unit 4 is connected to the photosensitive member unit 50, being enabled to rotate about the shafts 49 as pivots, with which the developing means frame 45 is provided. With the rotational movement of the development unit 4 about the shafts 49, the photosensitive drum 1 is placed in contact with the development roller 40, or separated therefrom.

When the cartridge 7 is out of the apparatus main assembly, the development roller 40 is kept in contact with the photosensitive drum 1 by the force generated by a pair of springs or the like in the direction to rotate the development unit 4 about the shafts 49. In other words, the development roller 40 is kept pressed upon the photosensitive drum 1 by the resiliency of the pair of springs (compression springs) 54 as elastic members.

In the case of the contact type developing method, in which the development roller 40 is placed in contact with the photosensitive drum 1 to develop a latent image on the photosensitive drum 1, the photosensitive drum 1 is desired be a rigid member, whereas the development roller 40 is desired to be a roller having an elastic surface layer. As the elastic surface layer, a single layer of solid rubber, or the like is employed. In consideration of the triboelectric charge which is given to the developer, the solid rubber layer may be coated with resin.

Figure 3:
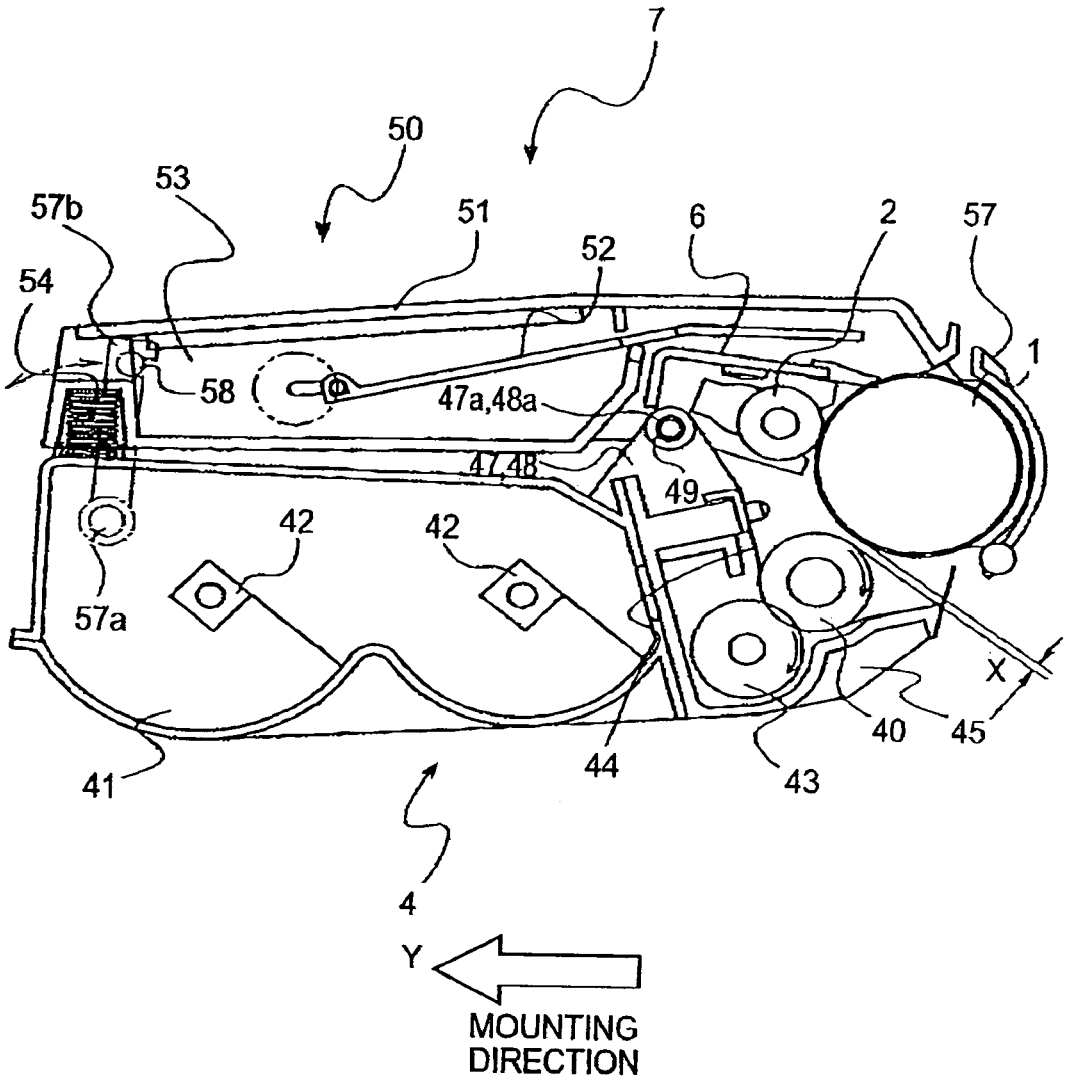
FIG. 3 is a schematic sectional view of the process cartridge, in the first embodiment of the present invention, which is not in the main assembly of the image forming apparatus, and in which its development roller remains separated by its separating means.

Referring to FIG. 3, reference numbers 57 and 58 designate a pair of means for keeping the development roller 40 away from the photosensitive drum 1 when the cartridge 7 is not in the main assembly A. More specifically, both lengthwise ends of the development unit 4 are provided with the development roller separating means 57 and 58. The development separating means 57 is in the form of a hook, whereas the developer separating means 58 is a catch with which each of the lengthwise ends of the photosensitive unit 50 is provided. The hook 57 is rotatable about the shaft 57*a*. As the cartridge 7 is inserted into the apparatus main assembly A, first, the development unit 4 is rotated about the shaft 49 against the resiliency of the springs 54 in the direction to cause the development roller 40 to be moved away from the photosensitive drum 1. As a result, the hooking portion 57*b* of the hook 57 catches the shaft portion 58 of the photosensitive member unit 50, preventing the development unit 4 from being rotated in reverse. Therefore, a predetermined gap X can be maintained between the development roller 40 and photosensitive drum 1 when the cartridge 7 is out of the apparatus main assembly A. Before the cartridge 7 is shipped out for distribution from the factory, the hooking portion 57*b* is to be engaged with the shaft 58 to immovably lock the development unit 4 to the photosensitive member unit 50 in order to prevent the peripheral surface of the development roller 40 from coming into contact with the peripheral surface of the photosensitive drum 1, preventing thereby the elastic layer of the development roller 40 from being deformed by the photosensitive drum 1, during the shipment. Further, when the cartridge 7 is not going to be used for a long time, the hook 57 may used to immovably lock the development unit 4 to the photosensitive member unit 50 to prevent the deformation of the elastic layer of the development roller 40, after taking the cartridge 7 out of the image forming apparatus main assembly A. When mounting the cartridge 7 into the image forming apparatus main assembly A, the hook 57 must be disengaged from the shaft 49 to unlock the development unit 4 from the photosensitive member unit 50.

(Process Cartridge Compartments of Apparatus Main Assembly and Mechanism for Separating Development Roller from Photosensitive Drum)

Figure 5:
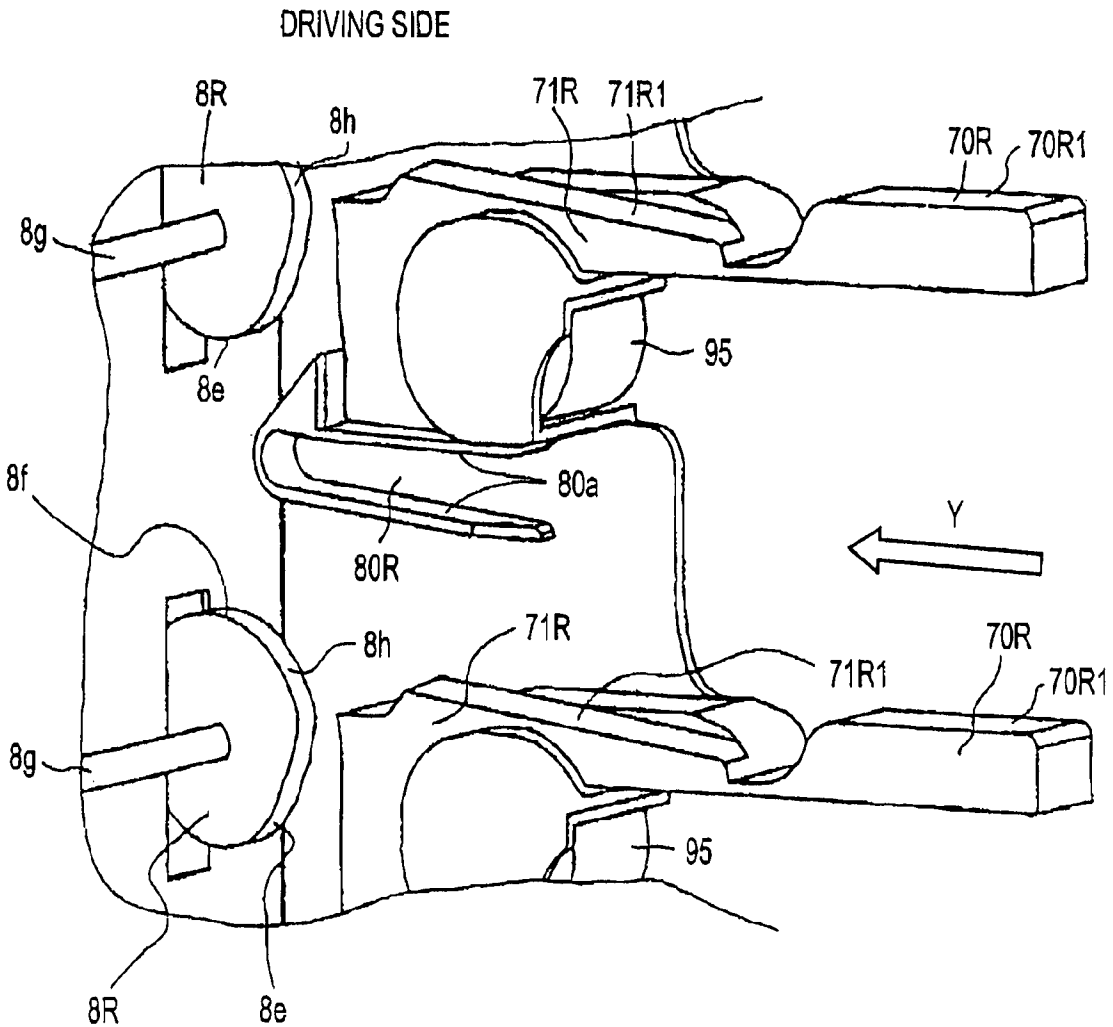
FIG. 5 is a perspective view of the developer roller separating portion (on the driven side, that is, the side from which developing means is driven) of the apparatus main assembly, showing the structure thereof.
Figure 6:
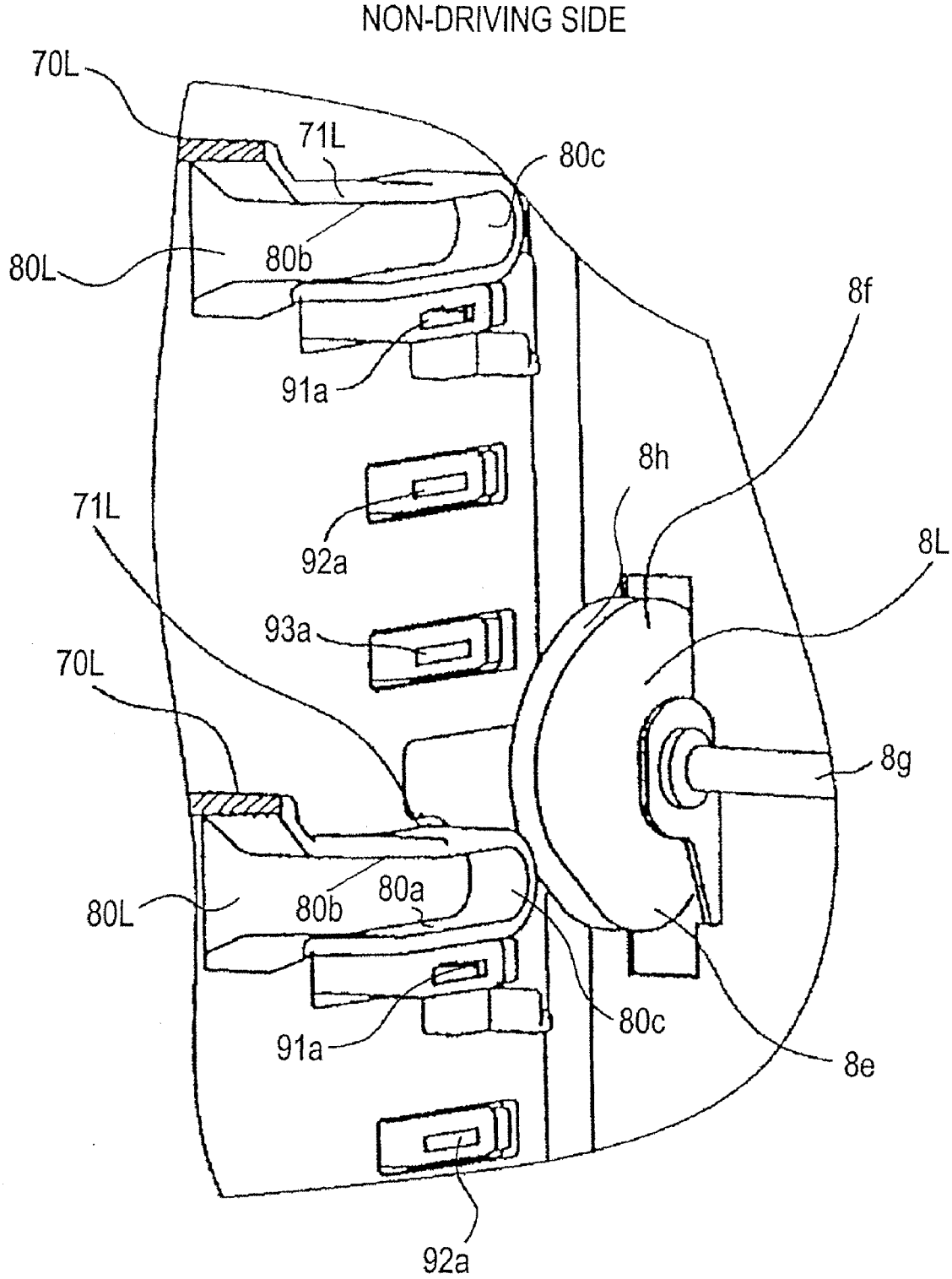
FIG. 6 is a perspective view of the developer roller separating portion (on the non-driven side, that is, the side from which the developing means is not driven) of the apparatus main assembly, showing the structure thereof.

Next, referring to FIGS. 4–6, the process cartridge compartment portion of the main assembly of the image forming apparatus, and the mechanism for separating, and keeping the development roller 40 separated, from the photosensitive drum 1 (which hereinafter will be referred to simply as separation mechanism), in this embodiment, will be described. FIG. 4 it a drawing for describing the structural arrangement (of cartridge compartment portion) of the apparatus main assembly for accommodating the process cartridges 7. FIGS. 5 and 6 are detailed drawings for describing the separation mechanism of the apparatus main assembly A. Incidentally, FIG. 4 shows only the photosensitive drum 1 and bearing 31 (31R and 31L); the cartridges 7 are not illustrated, in order to described the cartridge compartment structure in an easily understandable manner.

When mounting the cartridges 7 into the apparatus main assembly A or dismounting them therefrom, each cartridge 7 is to be inserted into, or extracted from, the cartridge compartments (100*a*–100*d*) of the apparatus main assembly A in the direction (indicated by arrow mark in drawing) intersecting (roughly perpendicular) to the axial line of the photosensitive drum 1. The cartridge compartments are the compartmental spaces which the cartridges 7 occupy as they are mounted into the positions in the apparatus main assembly A in which they can form images.

The apparatus main assembly A is provided with a space 200 for accommodating the cartridges 7. In terms of the lengthwise direction of the cartridge 7 (lengthwise direction of photosensitive drum 1), the dimension of the cartridge accommodating space 200 is greater than the dimension of the cartridge 7. Within this space, four cartridge compartments 100*a*–100*d* are vertically stacked in parallel.

The right lateral plate 32R and left lateral plate 32L of the apparatus main assembly A are provided with four cartridge insertion (extraction) guides (70R and 70L), respectively, for guiding the cartridges 7 into the image forming positions of the cartridges 7 in the cartridge compartments, providing therefore each cartridge compartment with a pair of cartridge guides (70R and 70L). The four pairs of cartridge guides are positioned in parallel at equal intervals. Each cartridge compartment is provided with a pair of cams 8 (8R and 8L) (which hereinafter may be referred to as "separation cams" or simply "cams") as means for keeping the development roller 40 separated from the photosensitive drum 1 (separating means). In terms of the cartridge insertion direction (cartridge mounting direction Y), the cams 8 are located at the deepest end of the cartridge compartment, whereas in terms of the direction intersecting (roughly perpendicular) the cartridge insertion direction, they are positioned at the right and left ends of the apparatus main assembly A. They are made of resin. The separation cams 8 rotate the development unit 4 about the shafts 49 to separate the peripheral surface of the photosensitive drum 1 from the peripheral surface of the development roller 40, in the cartridge 7. The separation cams 8R and 8L are attached to the lengthwise ends of the single rotatable shaft 8*g*, one for one. They are identical in shape and rotational phase. The functional surface 8*h* of each cam 8 is provided with a portion 8*e* with a smaller radius and a portion 8*f* with a larger radius. In other words, the cam 8 is shaped so that when the development roller 40 is in contact with the photosensitive drum 1, the cam 8 does not contact the cam follower portion 46 (46R and 46L in FIGS. 7 and 8) of the cartridge 7; In other words, a predetermined amount of gap W (FIG. 9*f* and FIG. 10*f*) is present between the smaller radius portion of the cam 8 and the cam follower portion 46. Further, the cam 8 is shaped so that the larger radius portion 8*f* of the cam 8 comes into contact with the cam follower portion 46 of the cartridge 7 to separate the development roller 40 from the photosensitive drum 1, and then, maintains a predetermined amount of gap X (FIGS. 9*e* and 10*e*) between the development roller 40 and photosensitive drum 1. The smaller radius portion 8*e* and larger radius portion 8*f* of the functional surface 8*h* of the cam 8 are given a smooth curvature so that the development roller 40 can be smoothly separated from the photosensitive drum 1. The right and left cams 8R and 8L are attached to the shaft 8*g* so that they become the same in rotational phase.

The shaft 8*g* is intermittently rotated by half a rotation by a motor (unshown) with which the apparatus main assembly A is provided. As the shaft 8*g* is rotated half a rotation, the cams 8 (8R and 8L) rotate half a rotation; the cams 8 are switched in position between a first position in which the larger radius portions 8*f* of the functional surfaces 8*h* of the cams 8 face upward, and a second position in which the smaller radius portion 8*e* of the functional surface 8*h* of the cams 8 face upward (FIGS. 9*f* and 10*f*: cams 8 have taken second position).

Further, on the upstream side of the cam 8 in terms of the cartridge mounting direction Y, there is a guiding surface (71R and 71L) for guiding the cam follower portion 46 onto the separation cam 8. The guiding surfaces 71R1 and 71L1 are tilted slightly upward relative to the cartridge mounting direction Y, so that as the cartridge 7 is inserted into the apparatus main assembly A, the cam follower portion 46 is made to ride onto the separation cam 8, being thereby gradually lifted while causing the peripheral surface of the development roller 40 to be moved away from the peripheral surface of the photosensitive drum 1.

(Cartridge Structure for Separating Development Roller)

Next, referring to FIGS. 7 and 8, the process cartridge in the first embodiment of the present invention will be described. FIGS. 7 and 8 are perspective views of the cartridge 7 in this embodiment, which contains developer.

As described above, in the case of the process cartridge in this embodiment, its development unit 4 is connected to the photosensitive member unit 50 so that the development unit 4 can be pivoted in its entirety about the shaft 49, being movable relative to the photosensitive member unit 50. Further, the pair of springs 54 (compression springs: FIG. 2) as elastic members are placed between the front ends of the development unit 40 and the photosensitive member unit 50, in terms of the cartridge mounting direction, in a manner to keep the development unit 4 pressured in the direction to rotate the development unit 4 about the shaft 49 so that the development roller 40 is kept in contact with the photosensitive drum 1. In order to allow the pair of springs 54 to keep the development roller 40 in contact with the photosensitive drum 1, the hook 57 is disengaged from the shaft 58. The shaft 49 is fitted in the hole 47*a* and hole 48*a* of the bearing members 47 and 48 with which the lengthwise ends of the development unit 4 are provided; the development unit 4 is enabled to pivot about the axial lines of the holes 47*a* and 48*a*.

The cam follower portions 46 (46R and 46L), with which the cams 8 are placed in contact in order to move the development roller 40 away from the photosensitive drum 1, are integral parts of the bearing members 47 and 48 of the development unit 4. The holes 47*a* and 48*a*, the axial lines of which are the rotational centers of the development roller 40, are located between the development roller 40 and cam follower portion 46 in terms of the direction in which the cartridge 7 is mounted into the apparatus main assembly A. Also in terms of the cartridge mounting direction Y, the holes 47*a* and 48*a* are located on the downstream side of the development roller 40. When the cartridge 7, the essential components of which are positioned as described above, is mounted into the apparatus main assembly A, each cam 8 is positioned in the first position, that is, the position in which the larger radius portion 8*f* of the functional surface 8*h* of the cam 8 faces upward (so that it engages with cam follower portion 46). With this positioning of the cam 8, the follower portion 46 moves onto the large radius portion 8*f* of the functional surface 8*h* of the cam as the cartridge 7 is mounted into the apparatus main assembly A, assuring that the peripheral surface of the development roller 40 is kept the predetermined distance away from the peripheral surface of the photosensitive drum 1 except during image formation; in other words, when the image forming apparatus is kept on standby, the development roller 40 and photosensitive drum 1 remain separated from each other. Therefore, the peripheral surfaces of the photosensitive drum 1 and development roller 40 are prevented from suffering from damage resulting from contact pressure. In this embodiment, the distance by which the development roller 40 is kept separated from the photosensitive drum 1 is roughly 1 mm.

Next, the cam follower portions 46 will be described. The cam follower portion (first cam follower portion) 46R located at one end (driven side) of the cartridge 7 is located at a level below the level of the cartridge driving gear (helical gear) 90. This placement of the cam follower portion 46R makes it possible for the cam follower portion 46R to pass below a cartridge driving gear (helical gear) 95 (FIG. 5) on the main assembly side, when the cartridge 7 is mounted into the apparatus main assembly A. In other words, even though the cam follower portion 46R is positioned on the front side in terms of the cartridge mounting direction Y, the cam follower portion 46R does not interfere with the mounting of the cartridge 7 into the apparatus main assembly A; it does not collide with the gear 95, allowing the cartridge 7 to be smoothly mounted into the apparatus main assembly A. A gear of the apparatus main assembly A meshes with the gear 95 as the cartridge 7 is mounted into the apparatus main assembly A, and through which the force for rotating the development roller 40 is received from the apparatus main assembly A.

Incidentally, the driven side means the side from which the cartridge 7 receives the driving force from the apparatus main assembly A. In other words, the driven side means one of the lengthwise ends of the photosensitive drum 1 (lengthwise ends of cartridge 7), at which the coupler 1A and the gear of the apparatus main assembly A are located.

The non-driven side means the side opposite to the driven side, that is, the other lengthwise end of the photosensitive drum 1 (lengthwise end of cartridge 7).

The cam follower portion (second cam follower portion) 46L, which is located at the other end (non-driven side) is located inward of the electrical contacts 91, 92, and 93 located on the cartridge surface on the same end as the cam follower portion 46L is located, in terms of the lengthwise direction.

The charge bias electrical contact 91 as one of the electrical contacts on the cartridge side is an electrical contact to be connected to the charge bias electrical contact 91*a* (FIG. 6) on the apparatus main assembly side to apply voltage to the charge roller 2. The charge bias electrical contact 91 is a part of the photosensitive member unit 50. The development bias electrical contact 92 as one of the electrical contacts on the cartridge side is an electrical contact to be connected to the development electrical contact 92*a* (FIG. 6) of the apparatus main assembly A to apply voltage to the development roller 40. The blade electrical contact 93 is an electrical contact on the cartridge side. It is the electrical contact to be connected to the blade electrical contact 93*a* of the apparatus main assembly A to apply voltage to the development blade 44. The development electrical contact 92 and blade electrical contact 93 belong to the development unit 4.

As described above, the cam follower portion 46L is positioned inward of the electrical contacts 91, 92, and 93 located on the cartridge surface 7*a* located at one end of the cartridge 7, in terms of the lengthwise direction. With this placement of the cam follower portion 46L, as the cartridge 7 is mounted into the apparatus main assembly A, the cam follower portion 46L is allowed to pass on the inward side of the charge bias electrical contact 91*a*, development bias electrical contact 92*a*, and the blade electrical contact 93*a* of the apparatus main assembly A. Therefore, even though the cam follower portion 46L is located at the front end of the cartridge 7 in terms of the cartridge mounting direction, the cam follower portion 46L does not hinder the mounting of the cartridge 7 into the apparatus main assembly A; it does not collide with the charge bias electrical contact 91*a*, the development bias electrical contact 92*a*, and the blade bias electrical contact 93*a* of the apparatus main assembly A. Therefore, the cartridge 7 can be smoothly mounted into the apparatus mean assembly A.

Figure 12:
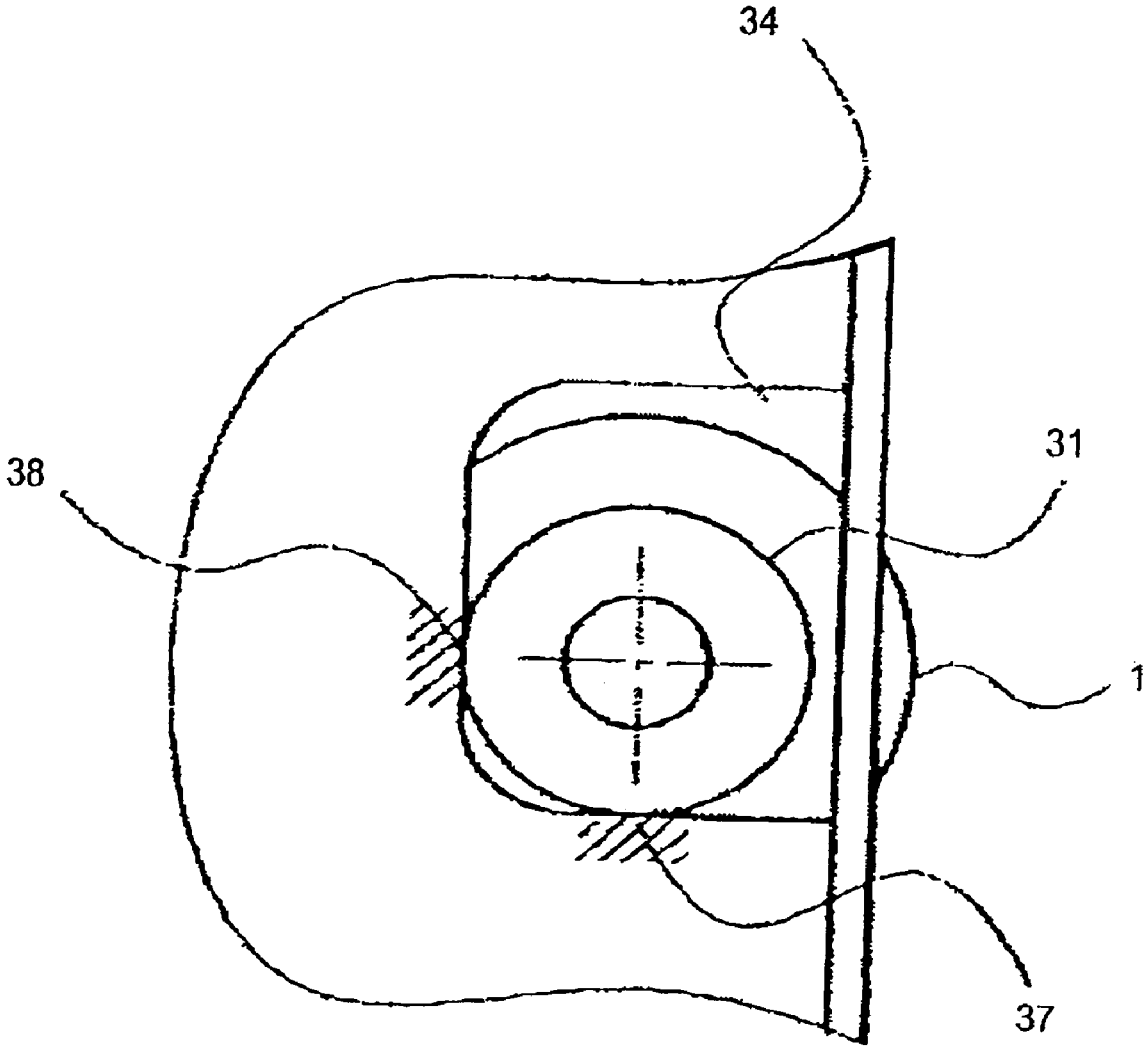
FIG. 12 is a schematic drawing for showing one of the essential portions of the structural arrangement for mounting the cartridge into the apparatus main assembly.
Figure 13:
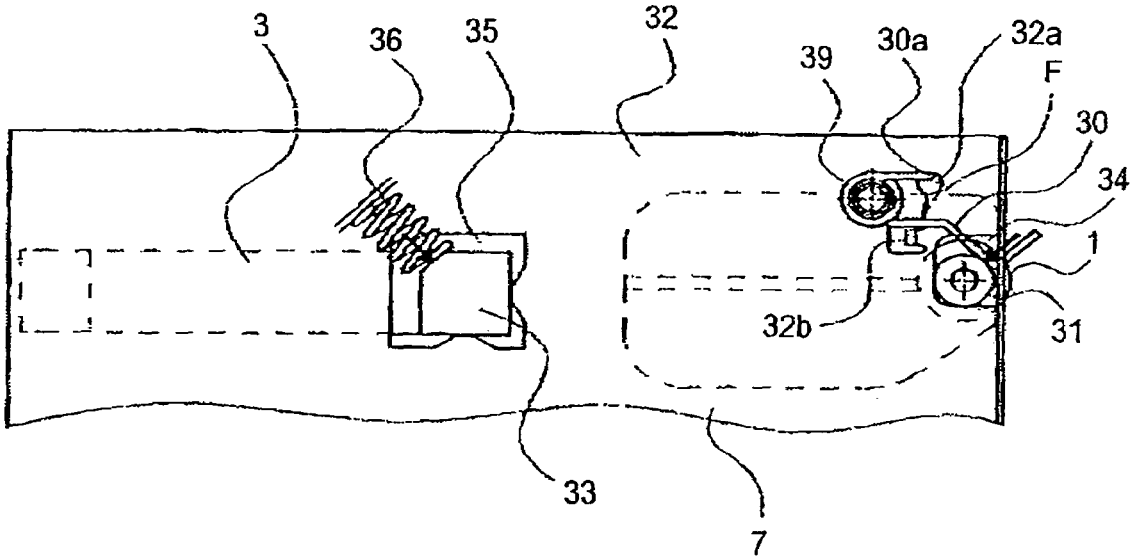
FIG. 13 is a schematic drawing for showing another of the essential portions of the structural arrangement for mounting the cartridge into the apparatus main assembly.

The cleaning means frame 51 is provided with a pair of projections 56 as portions by which the cartridge 7 is guided (first guidance projection 56R and second guidance projection 56L), which are located at the lengthwise ends of the cleaning means frame 51, one for one. Each guidance projection 56 is cylindrical and projects outward from the external surface of the frame 51. As the cartridge 7 is mounted into the apparatus main assembly A, the guidance projections 56 engage with the regulating portions 80 (80R and 80L) of the apparatus main assembly A, preventing the photosensitive member unit 50 from moving upward. In other words, the guidance projections 56 are prevented from moving upward, by the corresponding regulating portions 80 (80R and 80L), which extend at a level higher than that of the separation cams 8 and have a guiding surfaces 80*a*. The regulating portion 80 is in the form of a groove, into which the guidance projection 56 fits, being thereby guided in the cartridge mounting direction Y, by one of the guiding surfaces 80*a*, that is, the bottom surface 80*a* of the groove. While the guidance projection 56 is guided by the guiding surface 80*a*, it is prevented by the top surface 80*b* of the groove, from moving upward; in other words, the photosensitive member unit 50 is prevented from rotating upward about the shaft 49. The cartridge 7 being moved inward of the apparatus main assembly A is stopped by the surface 38 as the bearing 31 comes into contact with the end surface 38 (FIG. 12). When the cartridge 7 is stopped by the end surface 38, the projections 56R and 56L have not reached the end surface 80*c* of the groove. In other words, the projections 56R and 56L never come into contact with the end surface 80*c* of the groove.

The bearing members 47 and 48 are provided with guidance portions (first guidance portion 72R and second guidance portion 72L), that is, the portions which come into the guides (71R1 and 71L1) with which the apparatus main assembly A is provided. The guidance portions are integral parts of the development unit 4. The guidance portion projects below the level of the functional surface (surface which comes into contact with separation cam 8) of the cam follower portion 46 (46R, 46L). As the cartridge 7 is mounted deeper into the apparatus main assembly A, the guidance portions are guided by the guiding surfaces 71R1 and 71L1 of the guides, causing the development roller 40 to be gradually separated from the photosensitive drum 1.

In terms of the cartridge mounting direction Y, the guidance projections 56 located at the lengthwise ends of the cleaning means frame 51, one for one, are on the upstream side of the cam follower portions 46, and on the downstream side of the guidance portions. The provision of this structural arrangement enables the guidance projections 56 to prevent the photosensitive member unit 50 from being rotated upward by both the force the guidance portions catches as the cartridge 7 is mounted into the apparatus main assembly A, and the force the cam follower portion 46 catches as the development roller 40 is separated from the photosensitive drum 1 toward the end of the mounting of the cartridge 7 into the apparatus main assembly A. Therefore, the need for providing the cartridge 7 with two sets of regulating projections is eliminated, making it possible not only to simplify the cartridge structure, but also, to reduce the frictional resistance which occurs as the cartridge 7 is mounted into the apparatus main assembly A.

Designated by a reference symbol 1A is a coupling member as a driving force receiving member. The coupling member 1A is solidly attached to the lengthwise end of the shaft of the photosensitive drum 1, on the driven side. The driving force from the motor (unshown) of the apparatus main assembly A is transmitted to this coupling member 1A to rotate the photosensitive drum 1.

(Mounting of Process Cartridge into Apparatus Main Assembly A, and Separation of Development Roller from Photosensitive Drum, in Apparatus Main Assembly)

Next, referring to FIGS. 9*a*–13, the steps for mounting the cartridge 7 into the apparatus main assembly A, and the separation of the development roller 40 from photosensitive drum 1, which occurs in the apparatus main assembly A, will be described. FIGS. 9*a*–9*f* are drawings for showing the movements of the components on the driven side, which occur during the mounting of the cartridge 7 into the apparatus main assembly A. FIGS. 10*a*–10*f* are drawings for showing the movements of the components on the non-driven side, which occur when mounting the cartridge 7 into the apparatus main assembly A. FIGS. 10*a*–10*f* roughly correspond to FIGS. 9*a*–9*f*.

First, when the cartridge 7 is not in the apparatus main assembly A, the development roller 40 as a developing member is always in contact with the photosensitive drum 1 (FIG. 2).

The mounting of the cartridge 7 into the apparatus main assembly A is accomplished by inserting the cartridge 7 into the apparatus main assembly A, with the bearings 31R and 31L, which support the photosensitive drum 1, resting on the guides 70R and 70L and guided by the guiding grooves 34*a*–34*h*.

Figure 9A:
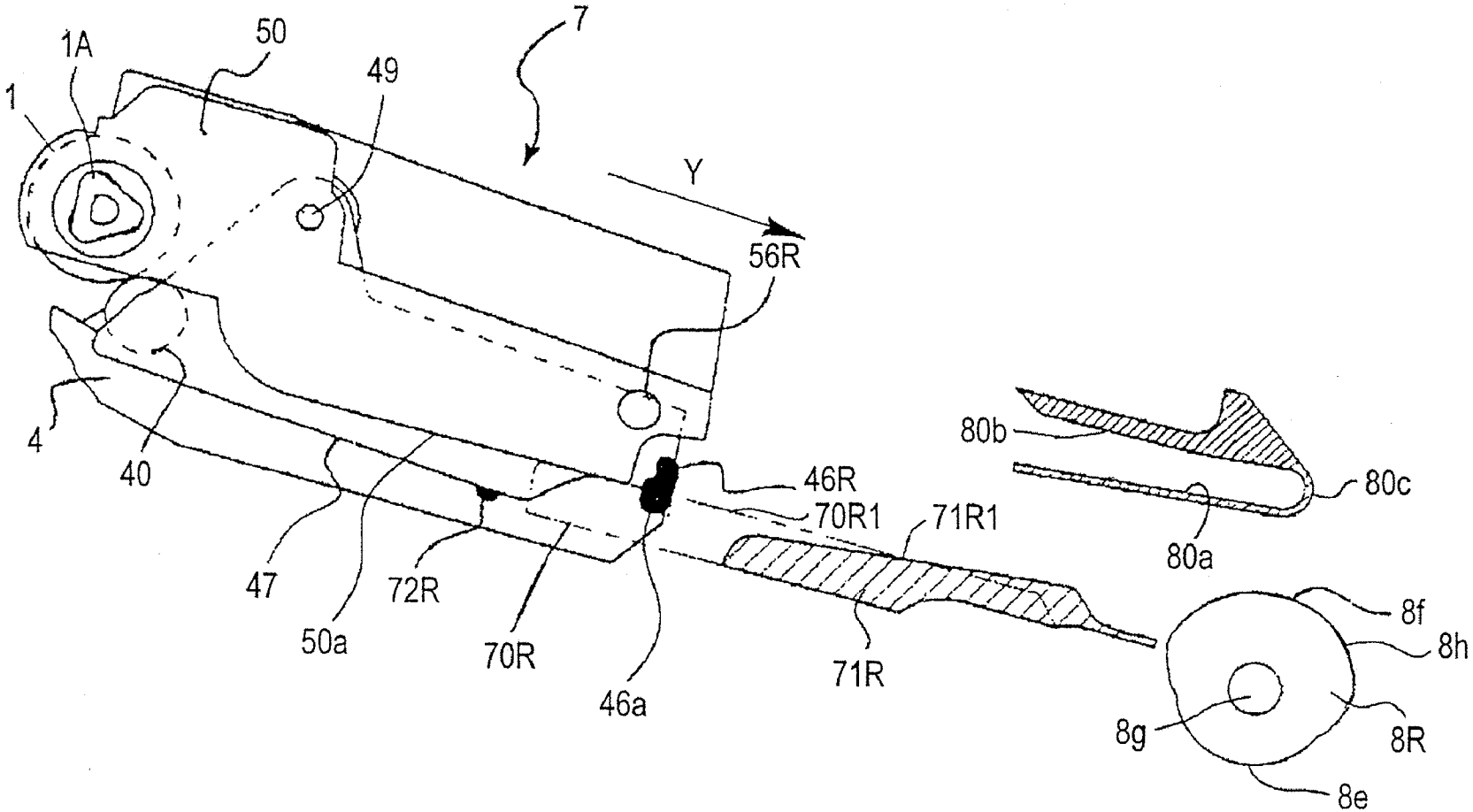
FIG. 9(*a*) is a schematic drawing for illustrating the sequence for mounting the process cartridge into the apparatus main assembly, on the driven side.
Figure 10A:
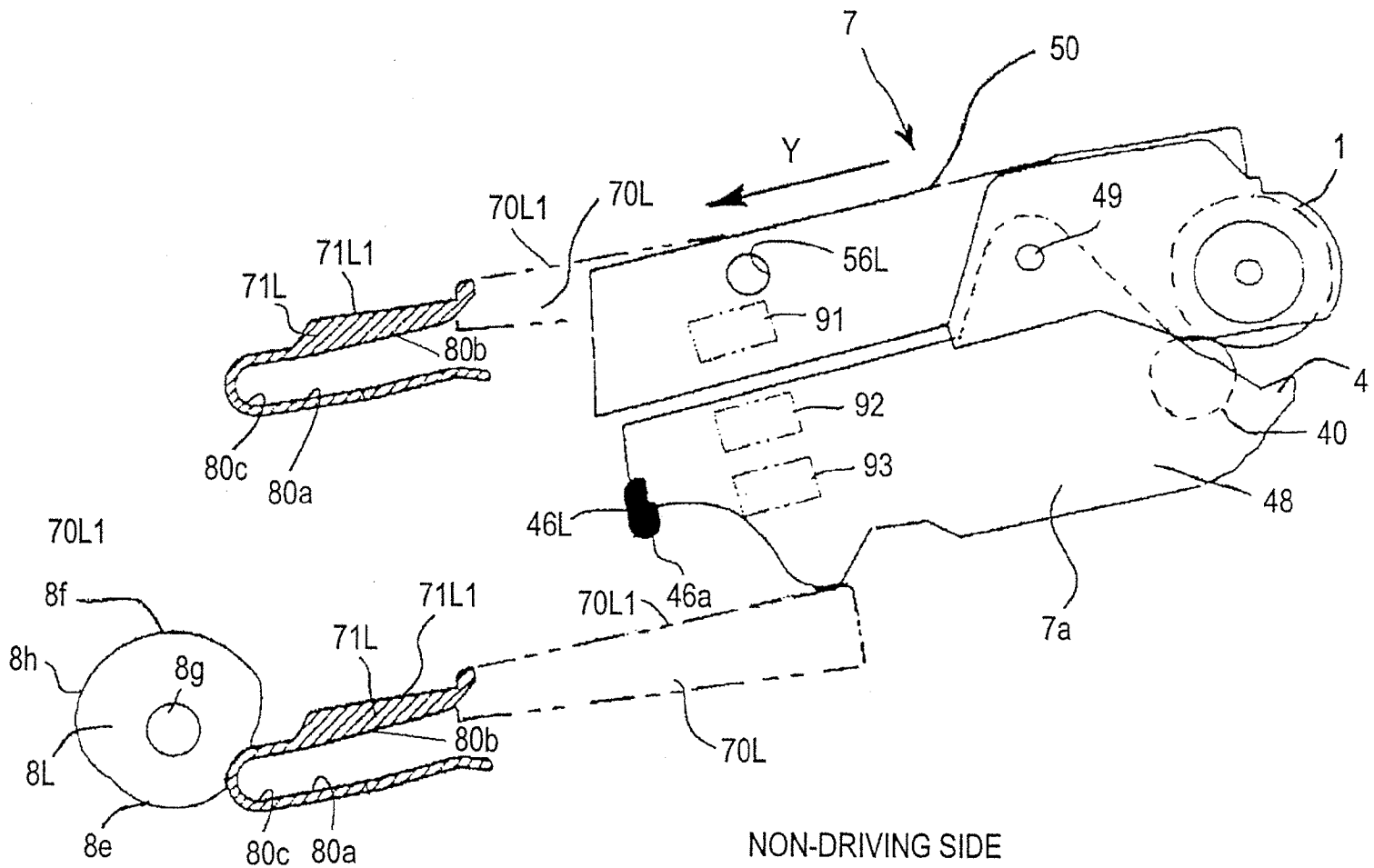
FIG. 10(*a*) is a schematic drawing for illustrating the sequence for mounting the process cartridge into the apparatus main assembly, on the non-driven side.

[FIG. 9*a*, FIG. 10*a*]: the cartridge 7 is inserted into the apparatus main assembly A through the opening 200 of the apparatus main assembly A. On the driven side, the bottom surface 50*a* of the photosensitive member unit 50 is rested on the guiding portion 70R of the right plate 32R of the apparatus main assembly A, whereas on the non-driven side, the guidance portion 72L of the development unit 4 (bearing member 48) is rested on the guiding portion 70L of the left plate 32L of the apparatus main assembly A. In this step, therefore, the cartridge 7 is being supported by the guiding portions 70R and 70L.

Figure 9B:
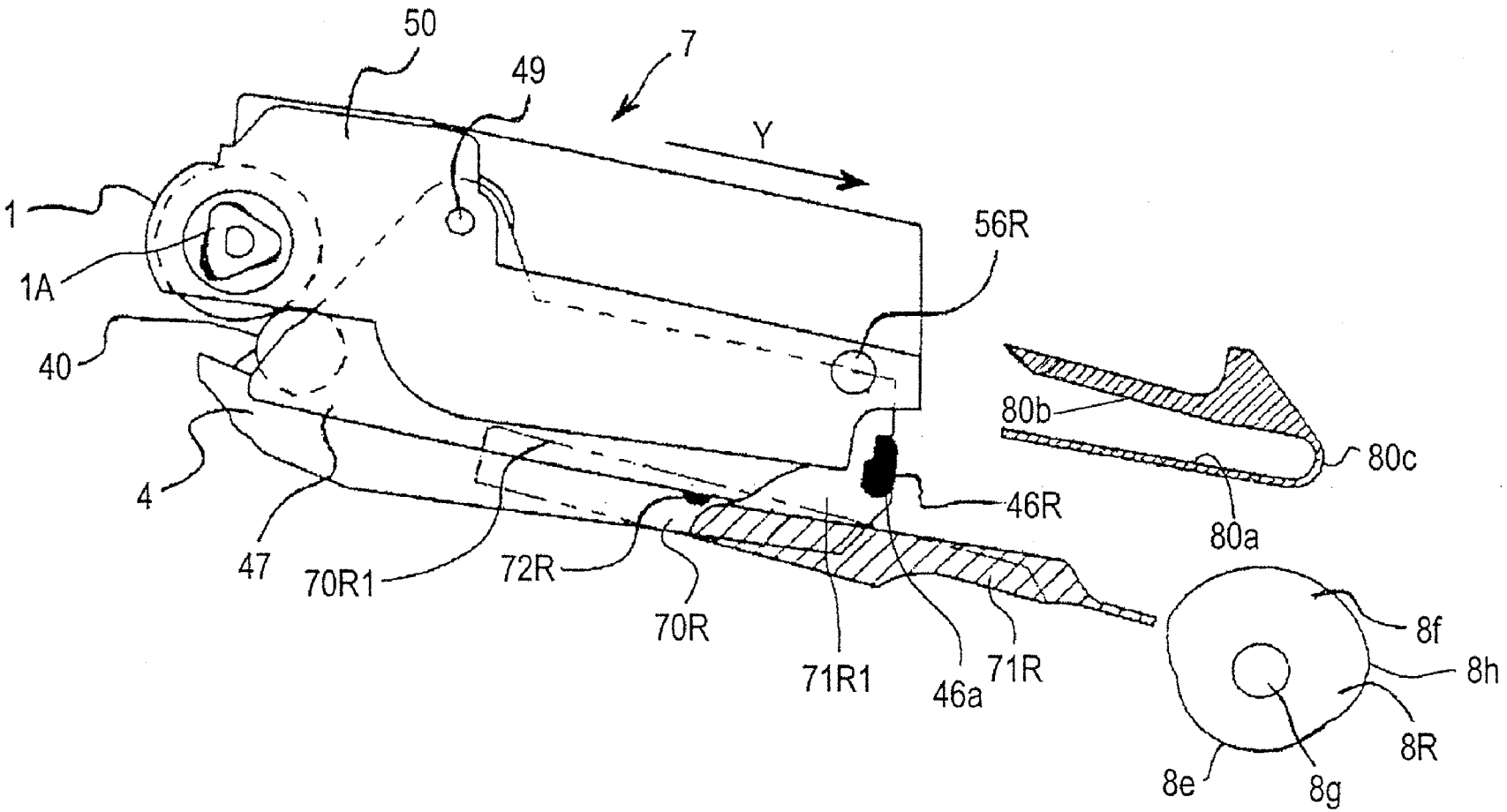
Figure 10B:
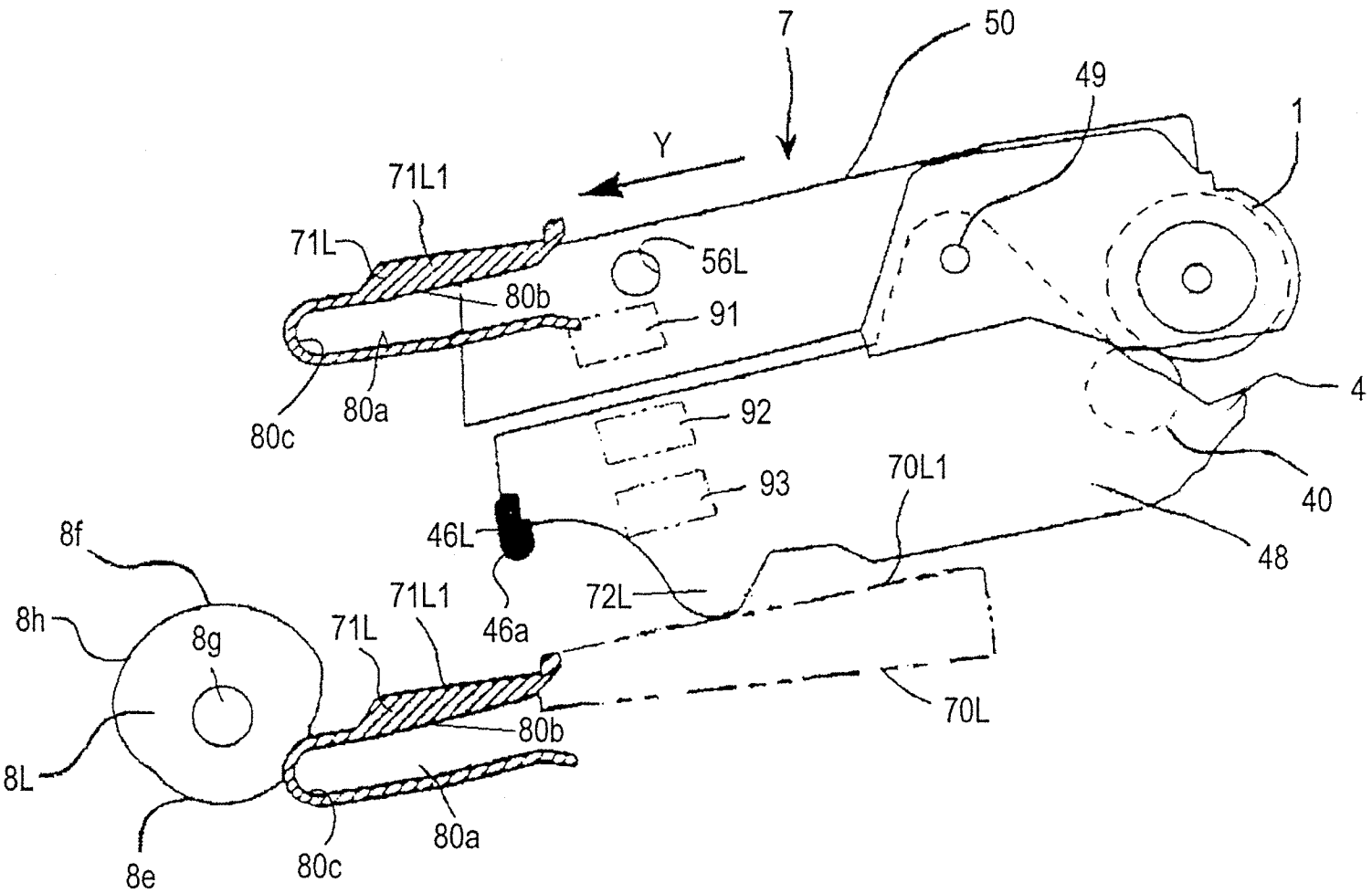

[FIG. 9*b*, FIG. 10*b*]: the cartridge 7 has been pushed deeper into the apparatus main assembly A, being guided by the guiding surfaces 70R1 of the guiding portion 70R, and the guiding surface 70L1 of the guiding portion 70L. On the driven side, the guidance portion 72R for lifting the development unit 4 is ready to move onto the guide 71R of the apparatus main assembly A. It should be noted here that the guidance portion 72R is on the bottom surface of the development unit 4.

Figure 9C:
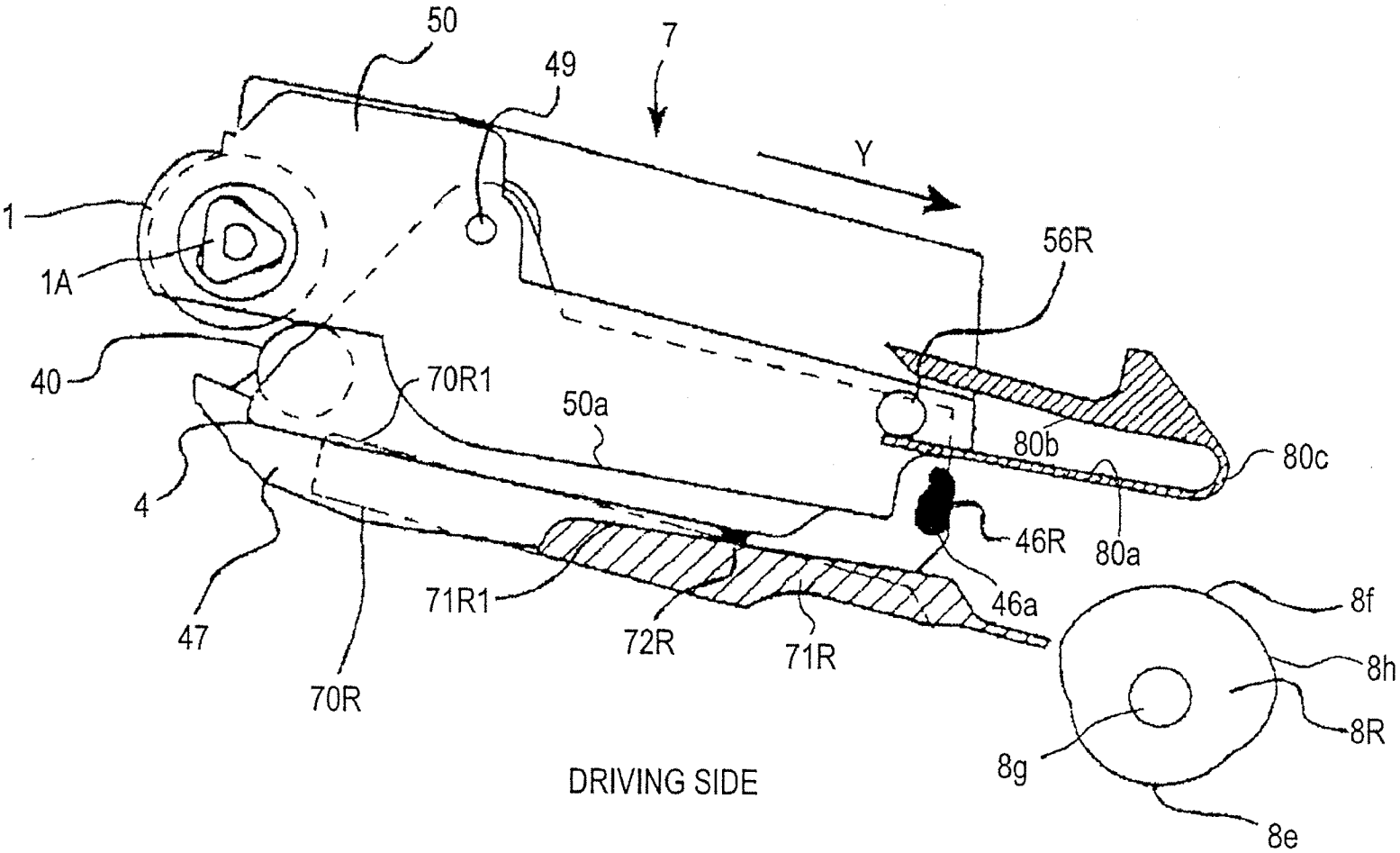
Figure 10C:
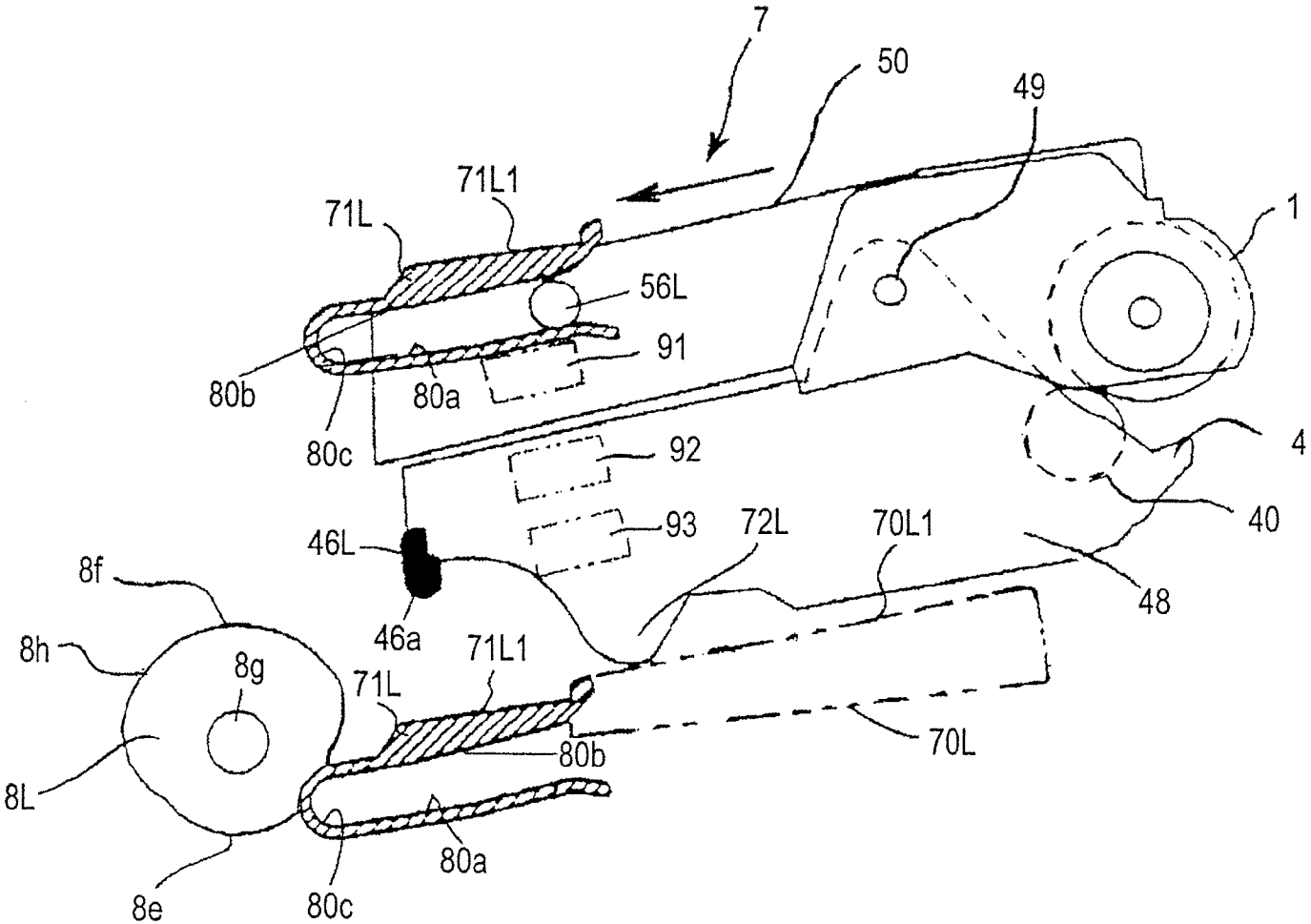

[FIG. 9*c*. FIG. 10*c*]: the cartridge 7 has been pushed even deeper into the apparatus main assembly A. On the driven side, the guidance portion 72R has moved onto the guide 71R of the apparatus main assembly A, and the guidance projection 56R of the photosensitive member unit 50, as the portion by which the cartridge 7 is guided, has moved into the regulating portion 80R of the apparatus main assembly A. Also on the non-driven side, the guidance projection 56L of the photosensitive member unit 50, as the portion by which the cartridge 7 is guided, has moved into the regulating portion 80L of the apparatus main assembly A. In other words, the guidance projections 56R and 56L projecting from the end surfaces of the cleaning means frame 51 in terms of the lengthwise direction engage in the regulating portions 80R and 80L, respectively, whereby the photosensitive member unit 50 is supported and guided by the guiding surfaces 80*a* of the regulating portions 80R and 80L, and therefore, the photosensitive member unit 50 is prevented from moving upward, because the regulating portions 80R and 80L are grooves, the top surfaces 80*a*, or the downwardly facing surfaces, of which prevent the guidance projections 56R and 56L from moving upward, respectively.

As the cartridge 7 in the above-described state is pushed even deeper into the apparatus main assembly A, the guidance portion 72R on the driven side is guided by the gently upwardly tilted guiding surface 71R1 of the guiding portion 71R. As a result, the development unit 4 is rotated about the shaft 49 in the direction to cause the development roller 40 to move away from the photosensitive drum 1, while gradually compressing the pair of springs 54 (FIG. 2) against the photosensitive member unit 50, which is being prevented from moving upward. As the development unit 4 is rotated upward about the shaft 49 in the above described direction, the gap created between the peripheral surfaces of the development roller 40 and photosensitive drum 1 by the upward rotation of the development unit 4 gradually increases, and also, the cam follower portions 46R and 46L are gradually moved upward. As for the inclination of the guiding surface 71R1, it is a gentle one; it is set so that the rate of rise becomes one to two centimeters per five centimeters.

Figure 9D:
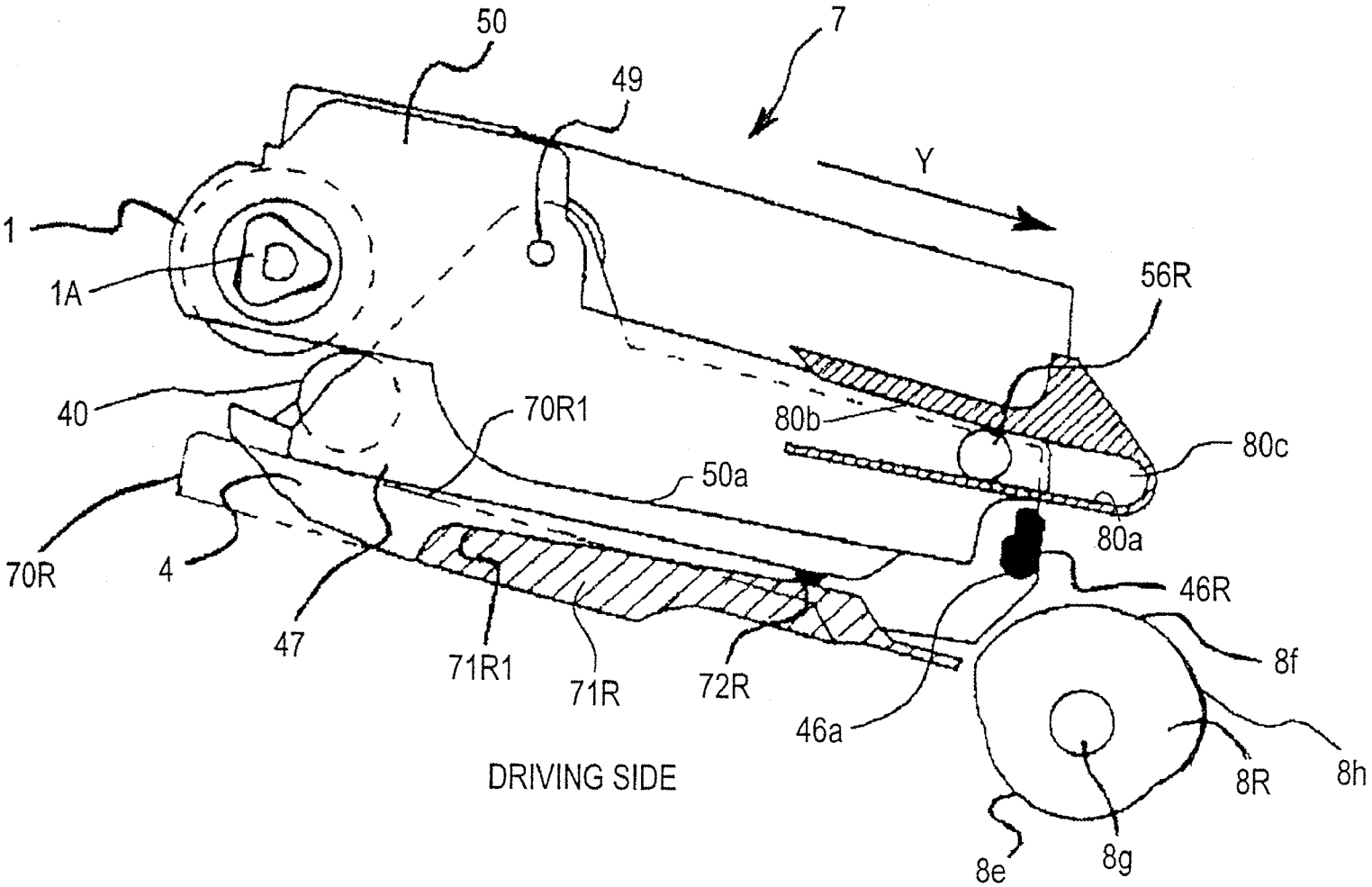
Figure 10D:
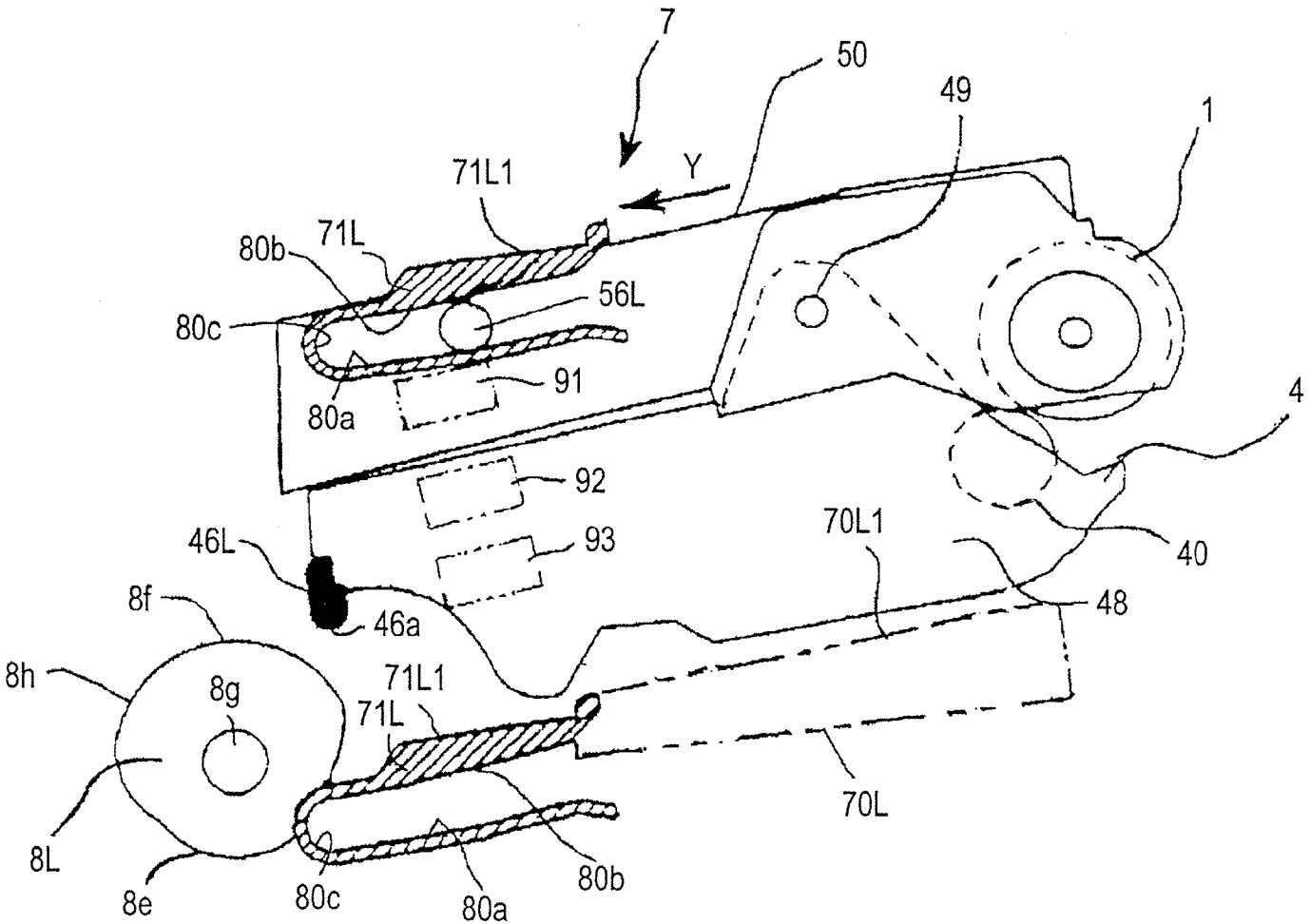

[FIG. 9*d*, FIG. 10*d*]: with the progression of the above-mentioned upward rotation of the development unit 4, the distance between the development roller 40 and photosensitive drum 1 has increased. Also, the cam follower portions 46R and 46L have been lifted to the highest points by the separation cams 8R and 8L, which are in the first positions in which their larger radius portions 8*f* are facing upward. On the non-driven side, the guidance portion 72L remains separated from the guiding surface 71L1 of the guide 71L, so that if the cartridge 7 is deformed, for example, twisted in such a manner that the driven side and non-driven side do not align in the lengthwise direction, the guidance portion 72L makes contact with the guiding surface 71L1 to guide the cartridge 7.

Figure 9E:
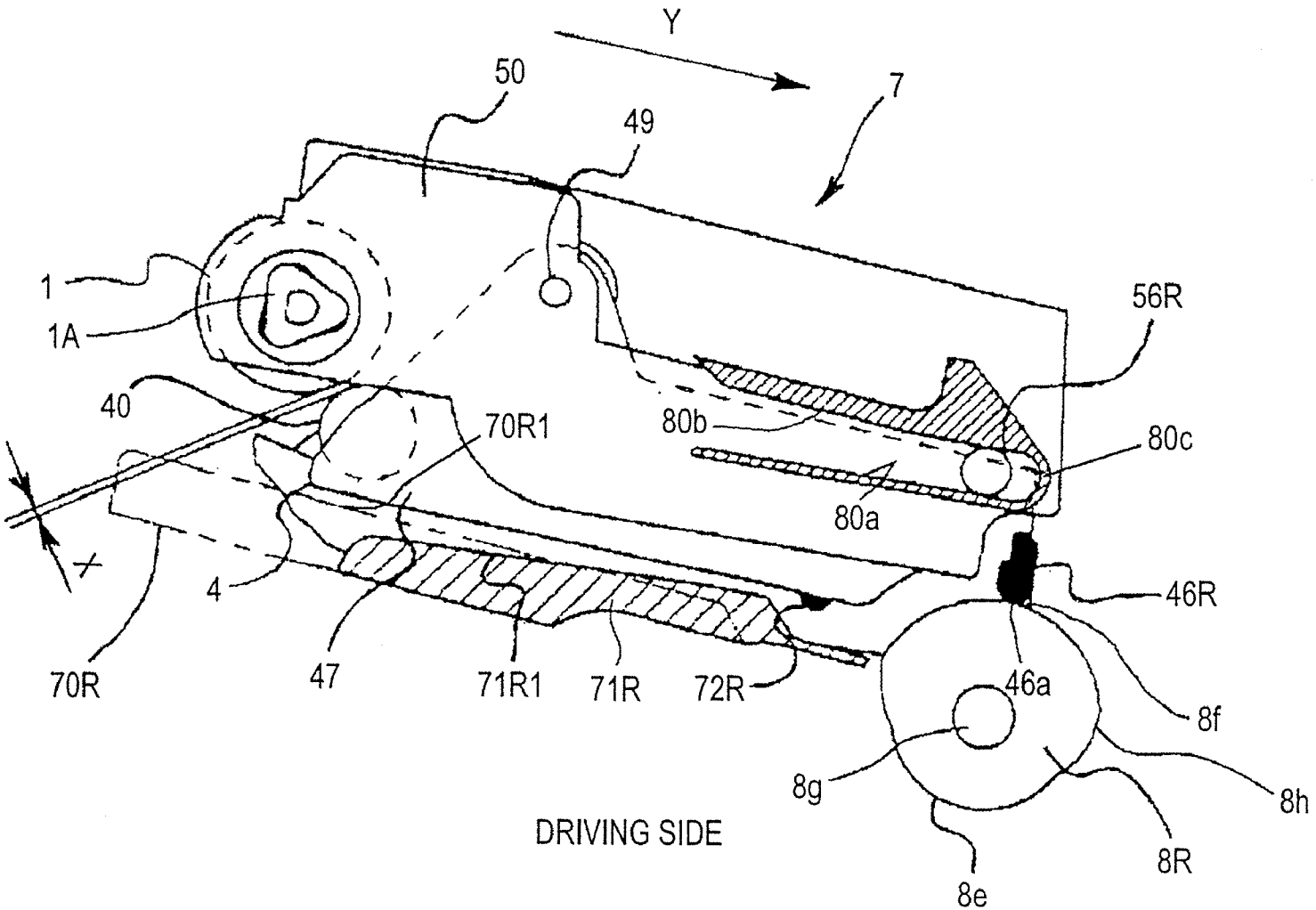
Figure 10E:
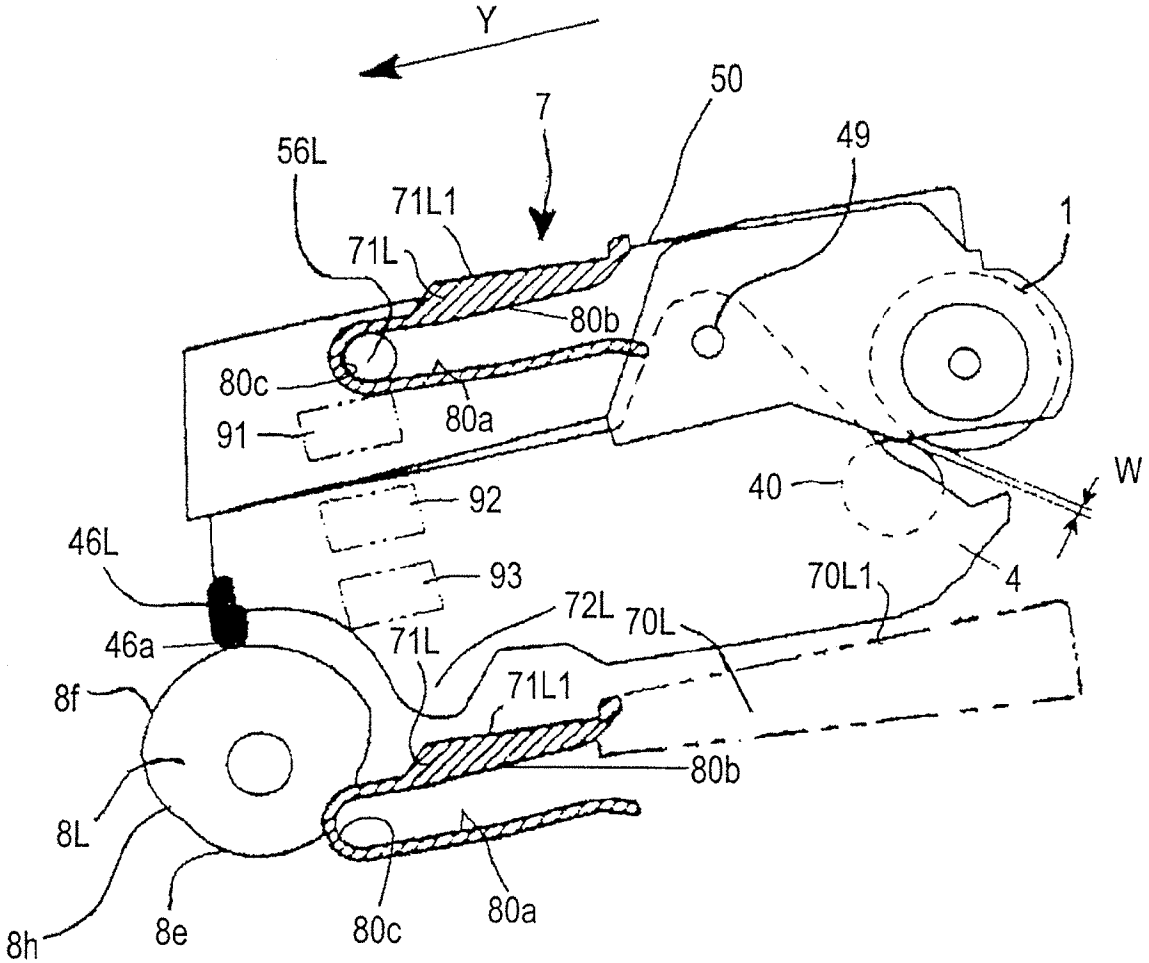

[FIG. 9*e*, FIG. 10*e*]: the cartridge 7 has been completely pushed into the image formation position. In this state, the guidance portion 72R has been lifted away from the guiding surface 71R, and the cam follower portions 46R and 46L have been moved to the highest points of the separation cams 8R and 8L Therefore, even though the guidance portion 72R has been lifted away from the guiding surface 71R, the development roller 40 is kept separated from the photosensitive drum 1.

Figure 11:
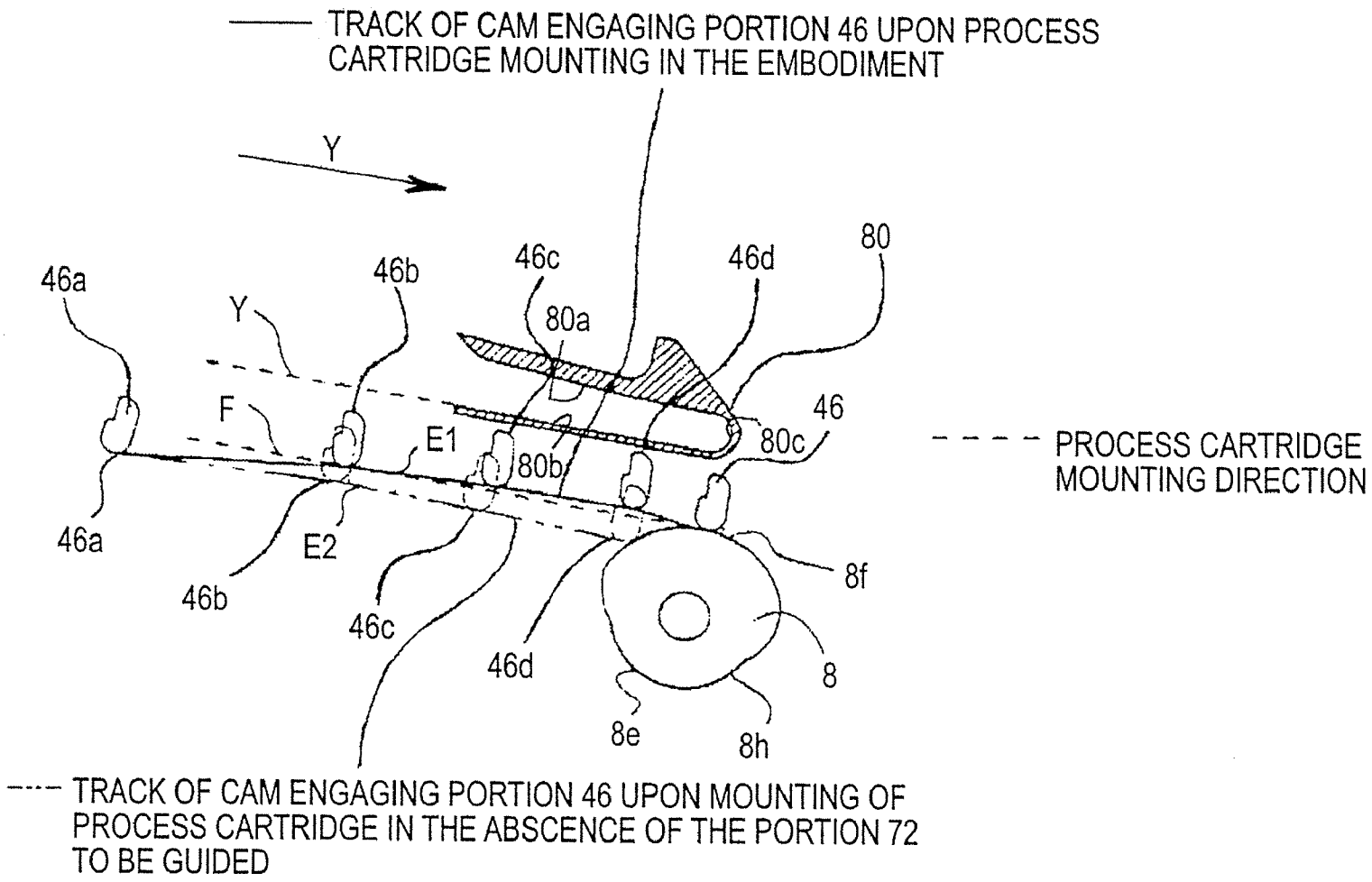
FIG. 11 is a schematic drawing for illustrating the path the cam follower portion of the process cartridge takes while the cartridge is mounted into the apparatus main assembly.

FIG. 11 is a schematic drawing (which corresponds to claims) showing the path which the cam follower portion 46 (46R, 46L) follows as the cartridge 7 in this embodiment is inserted into the apparatus main assembly A. The path E1 represented by the solid line is the path of the cam follower portion 46 during the mounting of the cartridge 7. In other words, the cartridge 7 is provided with the guidance portion 72R which comes into contact with the guiding surface 71R, remains in contact therewith while being guided by the guiding surface 71R in such a manner that the cam follower portion 46 is moved above the line F, which is parallel to the cartridge mounting direction Y and tangential to the functional surface 8*f* of the cam 8 (8R, 8L), and then, comes into contact with the highest point of the functional surface 8*f* of the separation cam 8 (8R, 8L) from above the line F, as the cartridge 7 is mounted into the apparatus main assembly A. With the provision of the above-described structural arrangement, the cam follower portion 46 moves through the path E represented by the solid line. In other words, the cam follower portion 46 moves above the functional surface 8*f* of the separation cam 8, and drops down onto the functional surface 8*f* of the separation cam 8. Therefore, the shock which occurs as the cartridge 7 moves into its image forming position in the cartridge compartment 100 can be softened. In this embodiment, the distance the cam follower portion 46 drops as the cartridge 7 finally moves into its image forming position is in the range of 1 mm–3 mm.

If the cartridge 7 is not provided with such a portion as the above-described guidance portion 72R by which the cartridge 7 is guided, the path which the cam follower portion 46 takes as the cartridge 7 is mounted into the apparatus main assembly A will become the double-dot chain line designated by a reference symbol E2 (this structural arrangement became apparent while developing the present invention, and is not a known technology). In this case, first, the cam follower portion 46 comes into contact with the peripheral portion of the functional surface 8*f* of the separation cam 8, and then, as the cartridge is pushed deeper into the apparatus main assembly A, the cam follower portion 46 is made to slide onto the highest point of the functional surface 8*f* of the separation cam 8. Therefore, the shook which occurs as the cam follower portion 46 comes into contact with the separation cam 8 is greater than when the cam follower 46 is made to take the path E1 represented by the solid line. In addition, there is the possibility that the separation cam 8 will be displaced by the impact which occurs as the cam follower portion 46 comes into contact with the edge portion of the functional surface 8*f* of the separation cam 8. In other words, without the provision of the guidance portion 72R, the separation cam 8 must be more firmly attached in order to prevent the cam 8 from being dislocated. This may lead to a cost increase.

As described above, this embodiment can prevent the separation cam 8 from being displaced; in other words, it can keeps the cam 8 accurately positioned, making it possible to accurately move the development roller 40 away from the photosensitive drum 1 at a precise moment.

Also, in the case that the path of the cam follower portion 46 is as shown by the double-dot chain line E2, the force applied to the cartridge 7 to mount the cartridge 7 into the apparatus main assembly A is directly caught by the separation cam 8, adding to the aforementioned impact. In comparison, in the case that the path of the cam follower portion 46 is as shown by the solid line E1, the force applied to the cartridge 7 to mount the cartridge into the apparatus main assembly A is not directly caught by the separation cam 8. Therefore, the amount of the aforementioned shock which occurs in this case is much smaller than that in the former case.

The reason why the cam follower portion 46 drops onto the separation cam 8 following the path E1 represented by the solid line is as follows: As the guidance portion 72R moves past the guiding portion 71R, that is, as the guidance portion 72R falls off the guiding surface 71R, the force which acts in the direction to cause the development roller 40 to come into contact with the peripheral surface of the photosensitive drum 1 is generated between the units 4 and 5 by the resiliency of the aforementioned pair of springs 54. As a result, the development unit 4 having the cam follower portion 46 is rotated downward about the shaft 49, causing the cam follower portion 46 to come into contact with the cam 8.

On the other hand, the guiding surface 71R, onto which the guidance portion 72R for lifting the development unit 4 moves, is inclined slightly upward relative to the downwardly inclined guiding surface 70R1 of the guide portion 70, in terms of the cartridge mounting direction Y. In other words, in terms of the cartridge mounting direction Y, the guiding surface 70R1 is inclined downward while the guiding surface 71R1 is inclined slightly upward. Therefore, as the cartridge 7 is pushed into the apparatus main assembly A, the development unit 4 is gradually rotated upward (lifted). Therefore, the force necessary to mount the cartridge 7 in this embodiment into the apparatus main assembly A in this embodiment is substantially smaller than that necessary to mount a process cartridge in accordance with the prior art into the apparatus main assembly A in accordance with the prior art.

The direction Y in which the cartridge 7 is mounted into the apparatus main assembly A is parallel to the direction in which the cartridge 7 is guided by the guide of the apparatus main assembly A located most downstream in terms of the cartridge mounting direction Y. In this embodiment, therefore, the cartridge mounting direction Y is parallel to the direction in which the guidance projection 56R and 56L are guided by the regulating portions 80R and 80L, respectively.

The embodiment is summarized as a process cartridge 7 detachably mountable to a main assembly A of an electrophotographic image forming apparatus, the process cartridge 7 including a cam member 8 movable between a first position and a second position which is retracted from the first position, the process cartridge comprising an electrophotographic photosensitive drum 1; a developing roller contactable to the electrophotographic photosensitive drum 1 at a development position to develop an electrostatic latent image formed on the electrophotographic photosensitive drum 1; a first frame 50 supporting the electrophotographic photosensitive drum; second frame supporting the developing roller 40, the second frame 4 being connected with the first frame 50 for rotation about a rotational axis so that developing roller 40 and the electrophotographic photosensitive drum 1 are contacted to or spaced from each other; a cam engaging portion 46 for receiving from the cam member which is located at a first position a force effective to space the developing roller 40 and the electrophotographic photosensitive drum 1 from each other in a state in which upward movement of the first frame is limited when the process cartridge 7 is mounted to the main assembly, the cam engaging portion 46 being provided on the second frame at a position downstream of the development position with respect to a process cartridge mounting direction Y at a side across the rotational axis from the development position with respect to the process cartridge mounting direction; and a portion to be guided 72 for being engaged and guided by a guide surface provided in the main assembly when said process cartridge is mounted to the main assembly, wherein the portion to be guided is guided by the guide surface such that the cam engaging portion 46 moves beyond above a tangent line F, parallel to the mounting direction, of a cam surface of the cam member to permit the cam engaging portion to be brought into contact to the cam surface from an upper position.

The process cartridge may further comprise a first cam engaging portion 46R which functions as a cam engaging portion adjacent an end which is at a leading and with respect to the mounting direction and which is at one end with respect to a longitudinal direction of the electrophotographic photosensitive drum, and a cartridge helical gear 90 (FIG. 7) for meshing engagement with a main assembly helical gear (not shown) provided in the main assembly A to receive a driving force for rotating the developing roller 40 from the main assembly, when the process cartridge is mounted to the main assembly A, wherein the first cam engaging portion 46R is disposed below a position of the cartridge helical gear.

The process cartridge may further comprise a second cam engaging portion 46L which functions as the cam engaging portion 46 adjacent an end which is at a leading end with respect to the mounting direction and which is at the other end with respect to a longitudinal direction of the electrophotographic photosensitive drum 1, and a cartridge electrical contact 91, 92 or 93 for electrical connection with a main assembly electrical contact (not shown) provided in the main assembly A when the process cartridge 7 is mounted to the main assembly A, wherein the second cam engaging portion 46L is disposed inside a position of the cartridge electrical contact with respect to the longitudinal direction.

The process cartridge may further comprise a portion to be regulated 56R, provided on the first frame 50 at the one longitudinal end, to be regulated by engagement by a regulating portion 80 provided in the main assembly A so as to limit an upward movement of the first frame 50 when the cam engaging portion 46R receives a force from the cam member, wherein the portion to be regulated 56 is disposed downstream of the portion to be guided disposed at the one longitudinal end and upstream of the first cam engaging portion 46R.

The process cartridge may further comprise an outwardly projected portion to be pressed 85 which continues from the portion to be regulated 56R and which extends from the portion to be regulated toward upstream, wherein when the process cartridge 7 is mounted to the main assembly A, an end surface of the portion to be regulated 56R and an end surface of the portion to be pressed 85 are elastically pressed by a main assembly pressing portion (not shown) provided in the main assembly.

The process cartridge may be such that when said cartridge 7 is mounted to the main assembly A, a leading end of the portion to be guided 72R which is contacted to the guiding surface 72R1 is projected downwardly beyond a position of contact between the first cam engaging portion 46R and the cam member 8.

The process cartridge may be such that the portion to be regulated 56R or 56L is guided by a guide surface extending to above the cam member, and the portion to be regulated is limited in upward movement by an upper surface 80*a* of the regulating portion which is in the form of a groove.

The process cartridge may further comprise a second portion to be regulated 56L, provided on the first frame at the other longitudinal end, to be regulated by engagement by a regulating portion provided in the main assembly so as to limit the upward movement of the first frame when the cam engaging portion receives a force from the cam member, wherein the second portion to be regulated 56L is disposed downstream of a second portion to be guided 72L disposed at the other longitudinal end and upstream of the second cam engaging portion 46L, wherein the second portion to be guided for being engaged and guided by the guide surface provided in said main assembly when the process cartridge is mounted to the main assembly A, wherein the second portion to be guided 72L is guided by the guide surface such that the cam engaging portion moves above the tangent line, parallel to the mounting direction, of the cam surface of the cam member to permit the cam engaging portion is to be brought into contact to the cam surface from an upper position.

The process cartridge may be such that said first portion to be guided 72R is projected downwardly when the process cartridge 7 is mounted to the main assembly A, and a leading end contacted to the guide surface 70R1 or 71R1 of the first portion to be guided 72R is projected downwardly beyond a position where the first cam engaging portion is contacted to the cam member.

Incidentally, in the above-described embodiment, the cartridge 7 is structured so that the guidance portions 72R and 72L of the bearing members 47 and 48 project below the level of the functional surfaces of the cam follower portions 46R and 46L. However, as long as the development roller 40 can be gradually moved away from the photosensitive drum 1, the cartridge structure does not need to be limited to the above-described one. For example, the developing means frame may be provided with the cam follower portions, or the portions of the bearing members 47 and 48 other than the above-described portions may be provided with the cam follower portions 46R and 46L.

Regarding the effects of forming the guidance portions 72R and 71L, as integral parts of the bearing members 47 and 48, generally, such substances as polycarbonate, polyacetal, etc., that are higher in rigidity are used as the material for the bearing members 47 and 48, from the standpoint of slipperiness and strength. Therefore, the guidance portions 72R and 72L are not likely to be easily affected by the force which acts thereon when the development roller 40 is moved away from the photosensitive drum 1; they are not likely to be warped or shaved. Therefore, the development roller 40 can be highly accurately moved away from the photosensitive drum 1. In other words, the formation of the guidance portions 72R and 72L, as integral parts of the bearing members 47 and 48, and the usage of one of the aforementioned substances as the material for the bearing members 47 and 48 improves the cartridge 7 in terms of the level of responsiveness with which the development roller 40 is moved away from the photosensitive drum. Further, forming the cam follower portions 46R and 46L as integral parts of the bearing members 47 and 48, respectively, offers the merit that the positional relationship among the development roller 40, the shaft 49 (rotational axis) of the development unit 4, and the cam follower portions 46R and 46L (development roller separation), and their measurements, can be assured, because they all are formed as integral parts of a single component. Therefore, the development roller 40 can be moved away from the photosensitive drum 1 with a high level of accuracy, and also, with a higher level of responsiveness. Therefore, the main assembly of the image forming apparatus is enabled to operate at a higher operational speed.

Further, since the cartridge 7 is structured, as described above, so that the guidance portions 72R and 72L of the bearing members 47 and 48 project below the level of the functional surfaces of the cam follower portions 46R and 46L, the functional surfaces of the cam follower portions 46R and 46L can be prevented from sliding on the functional surfaces of the separation cams 8 after the contact between the portions 46R and 46L and the functional surfaces, or the distance the cam follower portions 46R and 46L slide on the functional surfaces of the separation cams 8 can be minimized. Moreover, when mounting the cartridge 7 into the apparatus main assembly A, first, the bottom surface of the cartridge 7 is guided by the guiding portions 70R and 70L. In other words, by forming the guidance portions 72R and 72L as integral parts of the bottom wall of the cartridge 7, the cartridge 7 and the apparatus main assembly A can be improved in operational efficiency: guidance can be smoothly switched from the guiding portions 70R and 70L to the guiding surfaces 71 when mounting the cartridge 7 into the apparatus main assembly A. Incidentally, the functional surfaces of the cam follower portions 46R and 46L means the surfaces which contact the functional surface of the separation cams 8.

Referring to FIG. 12, as the bearings 31 (31R and 31L) are pressed upon the surfaces 37 and 38 of the guiding grooves 34, the cartridge 7 is moved into the image forming position in the apparatus main assembly A, shown in FIGS. 9*e* and 10*e*, being thereby properly positioned relative to the apparatus main assembly A; in other words, the mounting of the cartridge 7 into the apparatus main assembly A is completed.

In terms of the direction perpendicular to the cartridge mounting direction Y, the guiding portion 70R is positioned outward of the guiding portion 71R. In other words, the guiding portion 71R is positioned more inward of the apparatus main assembly A than the guiding portion 70R. In terms of the lengthwise direction, the guidance portion 72R is positioned inward of the bottom surface 50*a* which comes into contact with the guiding portion 70R. In terms of the direction perpendicular to the cartridge mounting direction Y, the guiding portion 70R and guiding portion 71R partially overlap. In terms of the cartridge mounting direction Y, the guiding portion 70R is positioned downstream of the guiding portion 71R. Thus, immediately after the entry of the cartridge 7 into the apparatus main assembly A, the bottom surface 50*a* is guided by the guiding portion 70R (guiding surface 70R1) (FIG. 9*b*). Then, as the cartridge 7 enters deeper into the apparatus main assembly A, the guidance portion 72R begins to be guided by the guiding portion 71R (guiding surface 71R1). It should be noted here that the bottom surface 50*a* is a part of the bottom surface of the photosensitive member unit 50, and the guidance portion 72R is a part of the bottom surface of the development unit 4.

On the other hand, the guidance portion 72L is guided by the guiding portion 70L, and the guiding portion 71L, that is, the top portion of the regulating member 80L (FIG. 10*a*). In other words, the upwardly facing surface of the top portion of the regulating member 80L is the guiding surface 71L1 which guides the guidance portion 72L. In terms of the direction perpendicular to the cartridge mounting direction Y, the guiding portions 70 and 71 are located roughly at the same position, within the apparatus main assembly A. Therefore, immediately after the entry of the cartridge 7 into the apparatus main assembly A, the cartridge 7 is guided by the guidance portion 72L, by the guiding portion 70L (guiding surface 70L1) (FIG. 10*b*). Then, as the cartridge 7 enters deeper into the apparatus main assembly A, the cartridge 7 is guided by the guidance portion 72L, by the guiding portion 71L (guiding surface 71L1). It should be noted here that the guiding portion 71L doubles as the regulating portion 80L for regulating the cartridge 7 mounted in the cartridge compartment 100 immediately below.

The method for keeping the cartridge 7 pressed in the apparatus main assembly A is as follows. That is, referring to FIG. 13, the side plate 32 is provided with a shaft 39, which is attached to the side plate 32 by crimping. Supported by the shaft 39 is a coil spring 30. One end 30*a* of the coil spring is fixed to the side plate 32; it is held in the hole 32*a* of the side plate 32. When the cartridge 7 is not in the apparatus main assembly A, the spring 30 is kept torqued in the rotational direction by the retainer 32*b*. Then, as the cartridge 7 is inserted into the apparatus main assembly A, the spring 30 is rotated in the counterclockwise direction against its resiliency. Then, as soon as it goes over the bearing 31, it begins to elastically press the bearing 31.

Referring to FIG. 7, the cartridge 7 is provided with a pressure catching portion 85, which perpendicularly projects from the side wall of the cartridge 7, and extends upstream, in terms of the cartridge mounting direction Y, from the guidance (regulation) projection 56R as the first regulating portion on the driven side. The end surface 56R1 (FIG. 7) of the projection 56R, and end surface 85*a* (FIG. 7) of the pressure catching portion 85, in terms of the lengthwise direction, are elastically pressed by the pressing means (for example, spring (unshown)) of the apparatus main assembly A, when the cartridge is mounted into the apparatus main assembly A. More specifically, the cartridge 7 is precisely positioned within the apparatus main assembly A in the following manner. The apparatus main assembly A is provided with the aforementioned pressing means for pressing the cartridge 7 in the lengthwise direction. While the cartridge 7 is mounted into the apparatus main assembly A, this pressing means keeps the pressure catching portion 85 under pressure. Therefore, the cartridge 7 is mounted while being pressured in the lengthwise direction. In this embodiment, the pressing means is located on the right plate (32R) side, assuring that as the cartridge 7 is mounted into the apparatus main assembly A, it is precisely positioned relative to the left side plate 32L.

Referring to FIG. 4, the dimension of the aforementioned scanner unit 3 in terms of the lengthwise direction is greater than the distance between the right and left plates 32R and 32L. Thus, the right and left ends 33 of the scanner unit 3 project beyond the right and left plates 32R and 32L through the holes 35*a*–35*h* of the right and left plates 32R and 32L. The scanner unit 3 is kept pressured by a force of roughly 9.8 N exerted diagonally downward (at an angle of roughly 45°) by a compression spring 36. Therefore, it is assured that the unit 3 is kept pressed upon the scanner seat, remaining thereby accurately positioned.

Figure 9F:
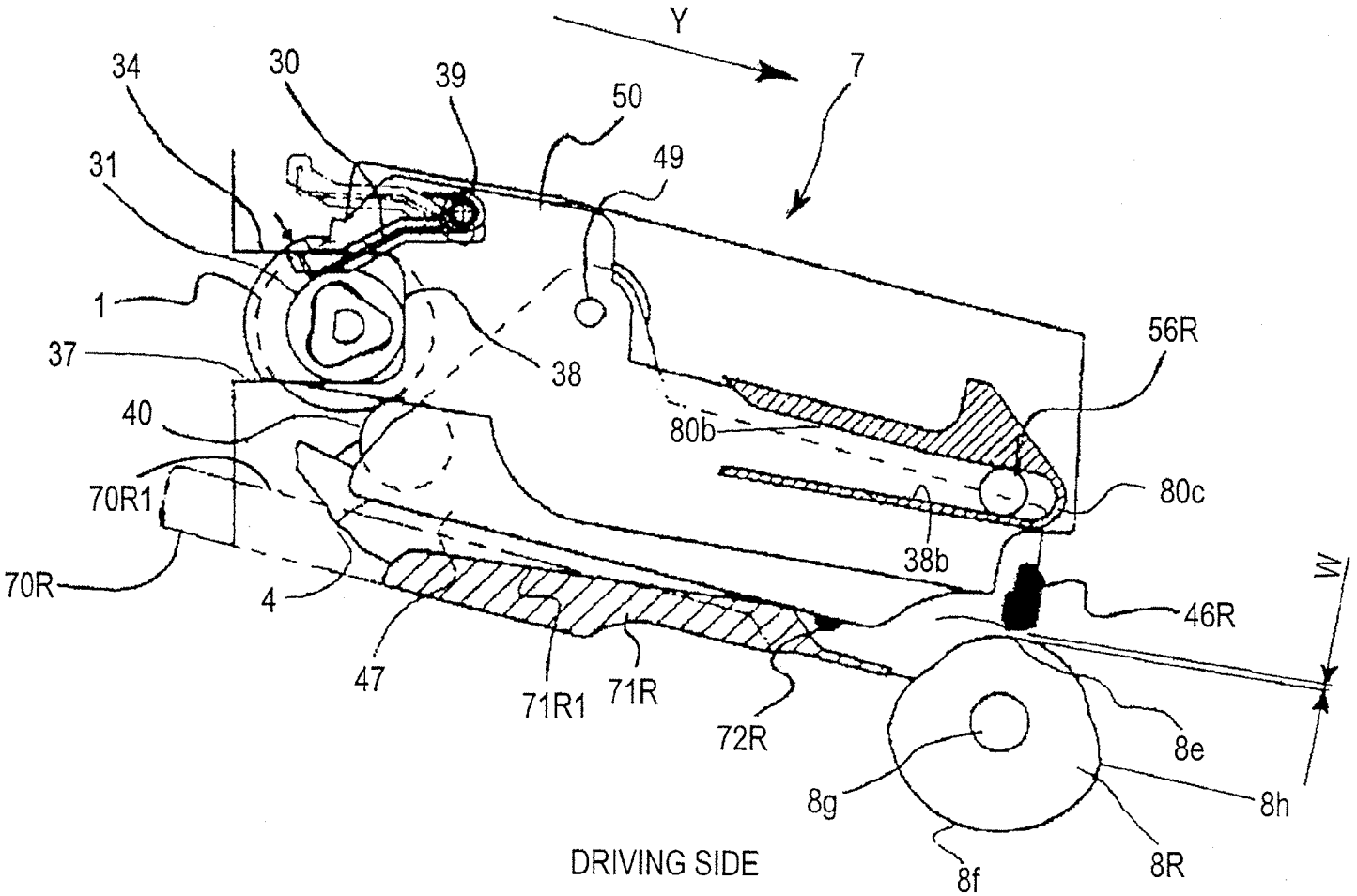
Figure 10F:
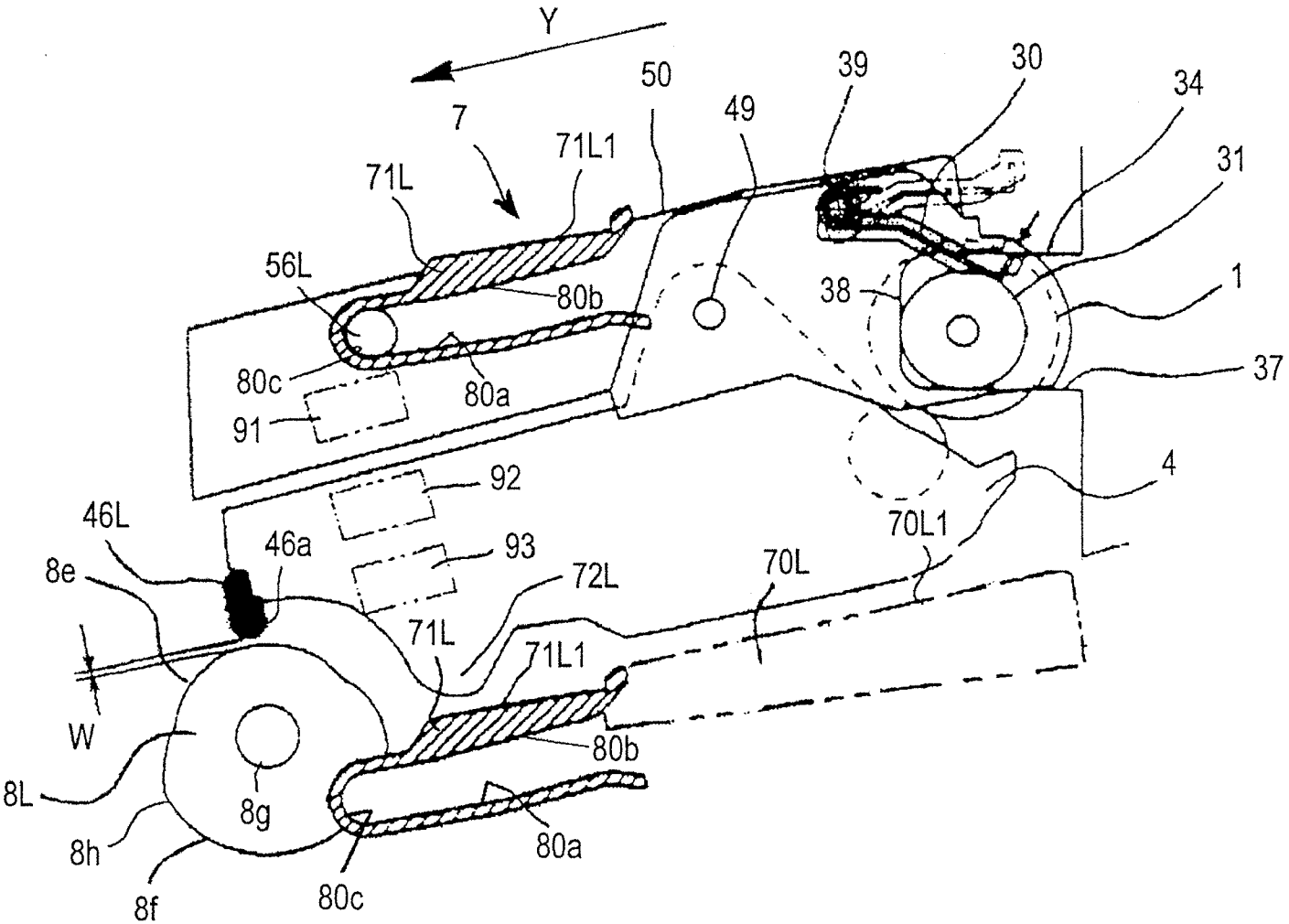

[FIG. 9*f*, FIG. 10*f*]: as soon as the cartridge 7 was completely mounted into the apparatus main assembly A, that is, as soon as the cartridge 7 was accurately positioned relative to the apparatus main assembly A, the cam 8, which had taken the first position in which its larger radius portion faced upward, has been rotated half a turn, taking therefore the second position in which its smaller radius portion 8*e* opposes the cam follower portion 46. With the cam 8 taking the second position, the force which held the development unit 4 upward against the photosensitive member unit 50 has been eliminated, allowing the development roller 40 to be placed in contact with the photosensitive drum 1 so that a predetermined amount of contact pressure is generated between the development roller 40 and photosensitive drum 1. In other words, the cartridge 7 is ready for image formation.

Figure 14:
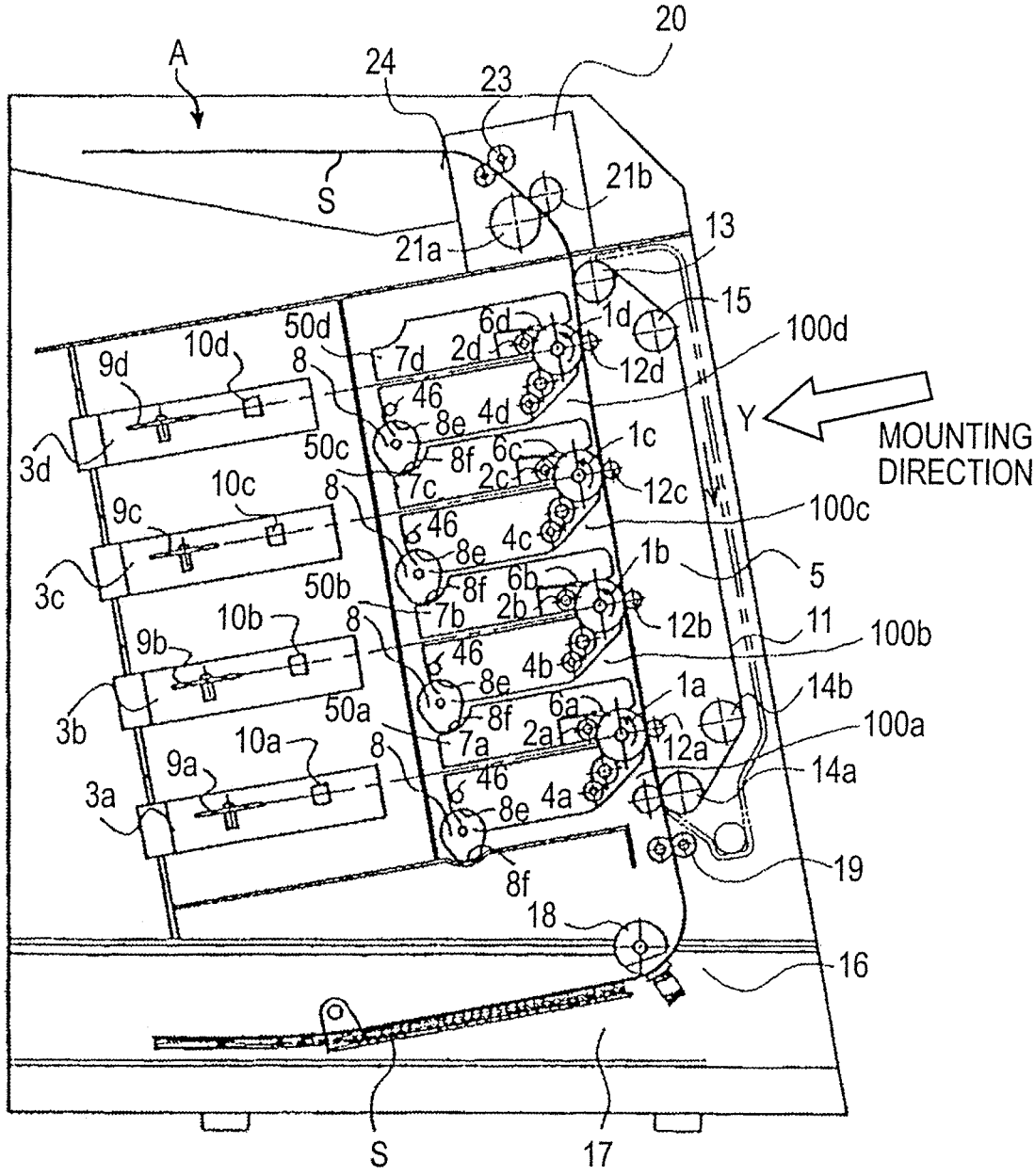
FIG. 14 is a schematic sectional view of the electrophotographic image forming apparatus in which the plurality of process cartridges are in the proper positions (positions in which they are capable of forming images).

Next, the separation of the development roller 40 from the photosensitive drum 1 which occurs after the completion of the mounting of the cartridge 7 into the apparatus main assembly A will be described in more detail. FIG. 14 shows the cartridge 7 which is in the apparatus main assembly A and ready for image formation.

As described above, the aforementioned separation cams 8 as the means for moving the development roller 40 away from the photosensitive drum 1 against the force being applied to the development unit 4 are located at the deepest end of the apparatus main assembly A, in terms of the cartridge insertion direction. They lift the cam follower portions 46*a*–46*d* of the yellow, magenta, cyan, and black color development units 4*a*–4*d*. They are rotatably connected to a stepping motor (unshown).

First, in the case where the cartridge 7 has been mounted into the apparatus main assembly A, but, no image is being formed (print signal is not been inputted), the driving force is not transmitted to the cams 8. In other words, the cams 8 remain in the state (first position) in which the large radius portions 8*f* of the cams 8 remain in contact with the cam follower portions 46, keeping the development rollers 40 away from the photosensitive drums 1, as shown in FIGS. 9*e*, 10*e*, and 1.

As an image forming operation is started by a print signal, the driving force is transmitted to the cams 8, rotating the cams 8 into the position (second position) in which the smaller radius portions 8*e* of the cams 8 oppose the cam follower portions 46*a*–46*d*. In other words, the cams 8 are separated from the cam follower portions 46*a*–46*d*. As the result, the development rollers 40 are placed in contact with the photosensitive drums 1 by the resiliency of the springs 54, readying the image forming apparatus for image formation.

After the completion of the image forming apparatus, the driving force is transmitted to the separation cams 8 in the direction opposite to the direction in which it was transmitted to start the image forming operation, rotating the cams 8 to the position (first position) in which their large radius portions 8*f* oppose the cam follower portions 46*a*–46*d*. Thus, the cams 8 come into contact with the cam follower portions 46*a*–46*d*, lifting therefore the development units 4 against the resiliency of the aforementioned springs 54. As the result, the development rollers 40 are again separated from the photosensitive drums 1; in other words, the state shown in FIGS. 9*e*, 10*e*, and 1 are restored.

As described above, according to the present invention, the apparatus main assembly A is provided with the guiding surface 71R gently inclined relative to the cartridge mounting direction Y, and the cartridge 7 is guided by placing the guidance portion 72R of the cartridge 7 in contact with the guiding surface 71R. With the employment of this structural arrangement, it is possible to reduce the amount of the load to which the cartridge 7 and the apparatus main assembly A are subjected when the cam follower portion 46 is made to move onto the cam 8 to move the development roller 40 away from the photosensitive drum 1 while mounting the cartridge 7 into the apparatus main assembly A. Therefore, it is possible to provide the combination of the cartridge 7 and the apparatus main assembly A, which not only assure that the development roller 40 is separated and remains separated from the photosensitive drum 1 except for development, but also, are smaller in the amount of the force necessary to be applied to the cartridge 7 by an operator when mounting the cartridge 7 into the apparatus main assembly A, being therefore superior in operational efficiency.

Moreover, according to the present invention, it is possible to reduce the amount of impact which occurs as the cam 8 comes into contact with the cam follower portion 46, reducing thereby the possibility that the cam 8 will be displaced by the impact. Therefore, the process of separating the development roller 40 from the photosensitive drum 1 is not affected by the impact. Therefore, the development roller 40 is reliably separated from the photo-sensitive drum 1 with a high level of responsiveness.

In essence, according to the present invention, it is possible to reduce the amount of the impact which occurs as the cam follower portion of a process cartridge comes into contact with the cam of the main assembly of an image forming apparatus while the process cartridge is mounted into the apparatus main assembly.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 253012/2004 filed Aug. 31, 2004, which is hereby incorporated by reference.

What is claimed is:

1. A process cartridge detachably mountable to a main assembly of an electrophotographic image forming apparatus, said main assembly including a cam member movable between a first position and a second position which is retracted from the first position, said process cartridge comprising:

an electrophotographic photosensitive drum;

a developing roller contactable to said electrophotographic photosensitive drum at a development position to develop an electrostatic latent image formed on said electrophotographic photosensitive drum;

a first frame configured and positioned to support said electrophotographic photosensitive drum;

a second frame configured and positioned to support said developing roller, said second frame being connected with said first frame for rotation about a rotational axis so that said developing roller and said electrophotographic photosensitive drum contact or are spaced from each other;

a cam engaging portion configured and positioned to receive from the cam member which is located at the first position a force effective to space said developing roller and said electrophotographic photosensitive drum from each other in a state in which upward movement of said first frame is limited when said process cartridge is mounted to the main assembly, said cam engaging portion being provided on said second frame at a position downstream of the development position with respect to a process-cartridge mounting direction, in which said process cartridge is mounted to the main assembly of the apparatus, at a side of said process cartridge across the rotational axis from the development position with respect to the process-cartridge mounting direction;

a portion to be guided engagable and guidable by a guide surface provided in the main assembly when said process cartridge is mounted to the main assembly, wherein said portion to be guided is guided by the guide surface such that said cam engaging portion moves above a tangent line, parallel to the mounting direction, of a cam surface of the cam member to permit said cam engaging portion to be brought into contact with the cam surface from above the tangent line; and a first cam engaging portion which functions as said cam engaging portion adjacent an end which is at a leading end with respect to the mounting direction and which is at one end with respect to a longitudinal direction of said electrophotographic photosensitive drum, and a cartridge helical gear for meshing engagement with a main assembly helical gear provided in the main assembly to receive a driving force for rotating said developing roller from the main assembly, when said process cartridge is mounted to the main assembly, wherein said first cam engaging portion is disposed below a position of said cartridge helical gear.

2. A process cartridge according to claim 1, wherein said cam engaging portion further comprises a second cam engaging portion adjacent the leading end of said second frame and which is at the other longitudinal end of said electrophotographic photosensitive drum, and wherein said process cartridge further comprises a cartridge electrical contact configured and positioned to contact a main assembly electrical contact, provided in the main assembly, when said process cartridge is mounted to the main assembly, and wherein said second cam engaging portion is disposed further from the other longitudinal end of said electrophotographic photosensitive drum than said cartridge electrical contact.

3. A process cartridge according to claim 1 or 2, further comprising a portion to be regulated, provided on said first frame at said one longitudinal end, to be regulated by engagement with a regulating portion provided in the main assembly so as to limit upward movement of said first frame when said cam engaging portion receives the force from the cam member, wherein a first portion to be regulated functioning as said portion to be regulated is provided adjacent said one longitudinal end, and wherein said first portion to be regulated is disposed upstream of said first cam engaging portion and downstream of a first portion to be guided which functions as said portion to be guided and which is provided adjacent said one longitudinal end.

4. A process cartridge according to claim 3, further comprising an outwardly projected portion to be pressed which extends upstream from the first portion to be regulated with respect to the process-cartridge mounting direction, wherein when said process cartridge is mounted to the main assembly, an end surface of the first portion to be regulated and an end surface of the portion to be pressed are elastically pressed by a main assembly pressing portion provided in the main assembly.

5. A process cartridge according to claim 3, wherein when said process cartridge is mounted to the main assembly, a leading end of said first portion to be guided which contacts the guiding surface is projected downwardly beyond a position of contact between said first cam engaging portion and the cam member.

6. A process cartridge according to claim 3, wherein the regulating portion is in the form of a groove, wherein said portion to be regulated is guided by a guide surface extending above said cam member, and wherein said portion to be regulated is limited in upward movement by an upper surface of the regulating portion.

7. A process cartridge according to claim 1, wherein said cam engaging portion comprises:

i) a first cam engaging portion adjacent a leading end of said second frame with respect to the process-cartridge mounting direction and which is at one longitudinal end of said electrophotographic photosensitive drum; and ii) a second cam engaging portion adjacent the leading end of said second frame and which is at the other longitudinal end of said electrophotographic photosensitive drum, and wherein said process cartridge further comprises:

i) a cartridge helical gear configured and positioned to mesh with a main assembly helical gear provided in the main assembly to receive a driving force from the main assembly for rotating said developing roller when said process cartridge is mounted to the main assembly, wherein said first cam engaging portion is disposed below said cartridge helical gear;

ii) a cartridge electrical contact configured and positioned to contact a main assembly electrical contact provided in the main assembly when said process cartridge is mounted to the main assembly;

iii) a first portion to be regulated, provided on said first frame at said one longitudinal end, to be regulated by engagement with a regulating portion provided in the main assembly so as to limit upward movement of said first frame when said cam engaging portion receives the force from the cam member, wherein said second cam engaging portion is disposed further from the other longitudinal end of said electrophotographic photosensitive drum than said cartridge electrical contact, wherein said first portion to be regulated is disposed downstream of said portion to be guided and is disposed at said one longitudinal end and upstream of said first cam engaging portion; and iv) a second portion to be regulated, provided on said first frame at the other longitudinal end of said electrophotographic photosensitive drum, to be regulated by engagement by a second regulating portion provided in the main assembly so as to limit the upward movement of said first frame when said cam engaging portion receives the force from the cam member, wherein said second portion to be regulated is disposed downstream, with respect to the mounting direction, of a second portion to be guided disposed at the other longitudinal end of said electrophotographic photosensitive drum and upstream of said second cam engaging portion, wherein the second portion to be guided is engagable and guidable by the guide surface provided in the main assembly when said process cartridge is mounted to the main assembly, wherein the second portion to be guided is guided by the guide surface such that said cam engaging portion moves above the tangent line, parallel to the process-cartridge mounting direction, of the cam surface of the cam member to permit said cam engaging portion to be brought into contact with the cam surface from above the cam surface.

8. A process cartridge according to claim 7, wherein said portion to be guided is projected downwardly when said process cartridge is mounted to the main assembly, and wherein a leading end of said portion to be guided contacts the guide surface and is projected downwardly beyond a position where said first cam engaging portion contacts the cam member.

9. An electrophotographic image forming apparatus comprising:

a main assembly comprising a cam member in said main assembly and movable between a first position and a second position retracted from the first position; and a process cartridge demountably mountable to said main assembly, said process cartridge comprising:

an electrophotographic photosensitive drum, a developing roller contactable to said electrophotographic photosensitive drum at a development position to develop an electrostatic latent image formed on said electrophotographic photosensitive drum;

a first frame configured and positioned to support said electrophotographic photosensitive drum;

a second frame configured and positioned to support said developing roller, said second frame being connected with said first frame for rotation about a rotational axis so that said developing roller and said electrophotographic photosensitive drum contact or are spaced from each other;

a cam engaging portion configured and positioned to receive from said cam member which is located at the first position a force effective to space said developing roller and said electrophotographic photosensitive drum from each other in a state in which upward movement of said first frame is limited when said process cartridge is mounted to said main assembly, said cam engaging portion being provided on said second frame at a position downstream of the development position with respect to a process-cartridge mounting direction in which said process cartridge is mounted to said main assembly of said apparatus, at a side across the rotational axis from the development position with respect to the process-cartridge mounting direction;

a portion to be guided engagable and guidable by a guide surface, provided in said main assembly, when said process cartridge is mounted to said main assembly, wherein said portion to be guided is guided by the guide surface such that said cam engaging portion moves above a tangent line, parallel to the process-cartridge mounting direction of a cam surface of said cam member to permit said cam engaging portion to be brought into contact with said cam surface from above the tangent line; and a first cam engaging portion which function as said cam engaging portion adjacent an end which is at a leading end with respect to the process-cartridge mounting direction and which is at one end with respect to a longitudinal direction of said electrophotographic photosensitive drum, and a cartridge helical gear for meshing engagement with a main assembly helical gear provided in said main assembly to receive a driving force for rotating said developing roller from said main assembly, when said process cartridge is mounted to said main assembly, wherein said first cam engaging portion is disposed below a position of said cartridge helical gear, wherein when said process cartridge is mounted to such a position that said cam engaging portion is capable of receiving the force from said cam member, said cam engaging portion receives a force from said cam member located at the first position to rotate said second frame about the rotation axis, thus bringing said developing roller out of contact with said electrophotographic photosensitive drum.

* * * * *

UNITED STATES PATENT AND TRADEMARK OFFICE

CERTIFICATE OF CORRECTION

PATENT NO. : 7,184,686 B2
APPLICATION NO. : 10/950574
DATED : February 27, 2007
INVENTOR(S) : Kazuhiko Kanno et al.

It is certified that error appears in the above-identified patent and that said Letters Patent is hereby corrected as shown below:

IN THE DRAWINGS, SHEET 21, FIG. 11

"ABSCENCE" should read --ABSENCE--.

COLUMN 1:

Line 22, "printer." should read --printer,--.
Line 45, "is" should be deleted.

COLUMN 3:

Line 26, "an above" should read --above--.

COLUMN 6:

Line 3, "later" should read --later.--.

COLUMN 7:

Line 58, "fixed" should read --fixed on--.

COLUMN 9:

Line 7, "desired" should read --desired to--.
Line 44, "may" should read --may be--.
Line 63, "it" should read --is--.

COLUMN 13:

Line 16, "mean" should read --main--.

COLUMN 15:

Line 58, "8L" should read --8L.--.

COLUMN 16:

Line 49, "keeps" should read --keep--.

COLUMN 18:

Line 5, "leading and" should read --leading end--.

UNITED STATES PATENT AND TRADEMARK OFFICE

CERTIFICATE OF CORRECTION

PATENT NO. : 7,184,686 B2
APPLICATION NO. : 10/950574
DATED : February 27, 2007
INVENTOR(S) : Kazuhiko Kanno et al.

It is certified that error appears in the above-identified patent and that said Letters Patent is hereby corrected as shown below:

COLUMN 26:

Line 45 Claim 9, "function" should read --functions--.

Signed and Sealed this

Fifth Day of August, 2008

JON W. DUDAS
*Director of the United States Patent and Trademark Office*